US010709921B2

(12) United States Patent
Risacher

(10) Patent No.: US 10,709,921 B2
(45) Date of Patent: Jul. 14, 2020

(54) ASSEMBLY DEVICE AND SYSTEM FOR AN EXERCISE STRUCTURE, AND ASSOCIATED EXERCISE SYSTEM AND MOUNTING METHOD

(71) Applicant: Stéphane Rémy Daniel Sylvère Joseph Risacher, Tassin-la-Demi-Lune (FR)

(72) Inventor: Stéphane Rémy Daniel Sylvère Joseph Risacher, Tassin-la-Demi-Lune (FR)

( * ) Notice: Subject to any disclaimer, the term of this patent is extended or adjusted under 35 U.S.C. 154(b) by 47 days.

(21) Appl. No.: 15/986,969

(22) Filed: May 23, 2018

(65) Prior Publication Data

US 2018/0369631 A1 Dec. 27, 2018

Related U.S. Application Data

(63) Continuation of application No. PCT/FR2016/053124, filed on Nov. 28, 2016.

(30) Foreign Application Priority Data

Nov. 26, 2015 (FR) ..... 15 61429

(51) Int. Cl.
*F16M 13/00* (2006.01)
*A63B 17/04* (2006.01)
(Continued)

(52) U.S. Cl.
CPC ..... *A63B 17/04* (2013.01); *A63B 21/00047* (2013.01); *A63B 21/078* (2013.01); *A63B 23/1218* (2013.01)

(58) Field of Classification Search
CPC ..... A63B 69/34; A63B 47/0083; A63B 17/04; A63B 21/078
See application file for complete search history.

(56) References Cited

U.S. PATENT DOCUMENTS 5,346,448 A * 9/1994 Sollo ..... A63B 21/00181 482/104
9,278,246 B2 * 3/2016 Tambornino ..... A63B 21/078
(Continued)

OTHER PUBLICATIONS

English translation of International Search Report dated Apr. 28, 2017 in connection with PCT International Application No. PCT/FR2016/053124.

*Primary Examiner* — Amy J. Sterling
(74) *Attorney, Agent, or Firm* — John P. White; Cooper & Dunham

(57) ABSTRACT

The invention relates to an assembly device (5) for assembling an accessory to an exercise structure (1), said structure comprising at least one hole (10). The device is characterized in that it comprises at least one hollow main body extending longitudinally between two ends, which body is provided with a first opening and is intended to be inserted into the hole (10) and to receive a removable male connector that is to be inserted into the hollow main body through the first opening in order to connect the accessory and the hollow main body. The main body (51) defines a continuous empty inner space that opens at each end in order to form the first opening (511) and a second opening (516). The device is further characterized in that it also comprises a first removable cap for closing the first opening when the male connector is not inserted into the hollow main body. The invention relates to assembly devices and systems for an exercise structure.

19 Claims, 9 Drawing Sheets

(51) Int. Cl.

| | |
|---|---|
| *A63B 21/00* | (2006.01) |
| *A63B 21/078* | (2006.01) |
| *A63B 23/12* | (2006.01) |

(56) References Cited

U.S. PATENT DOCUMENTS

| | | | | |
|---|---|---|---|---|
| 9,289,638 | B2 * | 3/2016 | Towley, III ..... | A63B 21/00047 |
| 2012/0264550 | A1 | 10/2012 | Shwartzman | |
| 2013/0109545 | A1 | 5/2013 | Chen | |
| 2015/0076092 | A1 | 3/2015 | Tambornino et al. | |

* cited by examiner

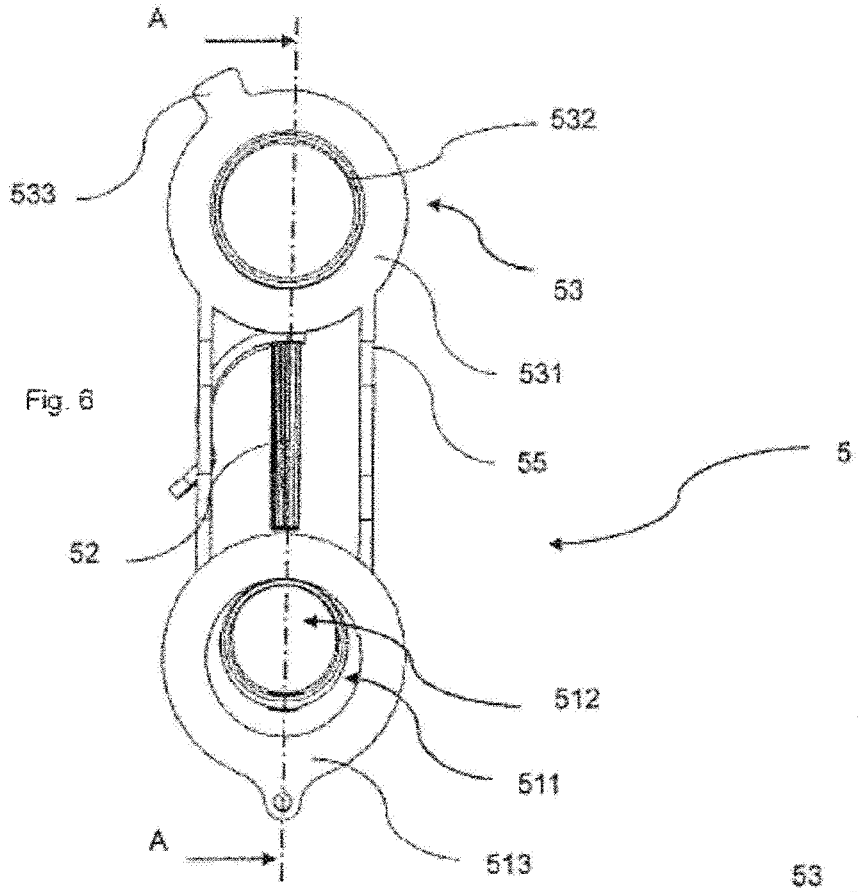
Fig. 6
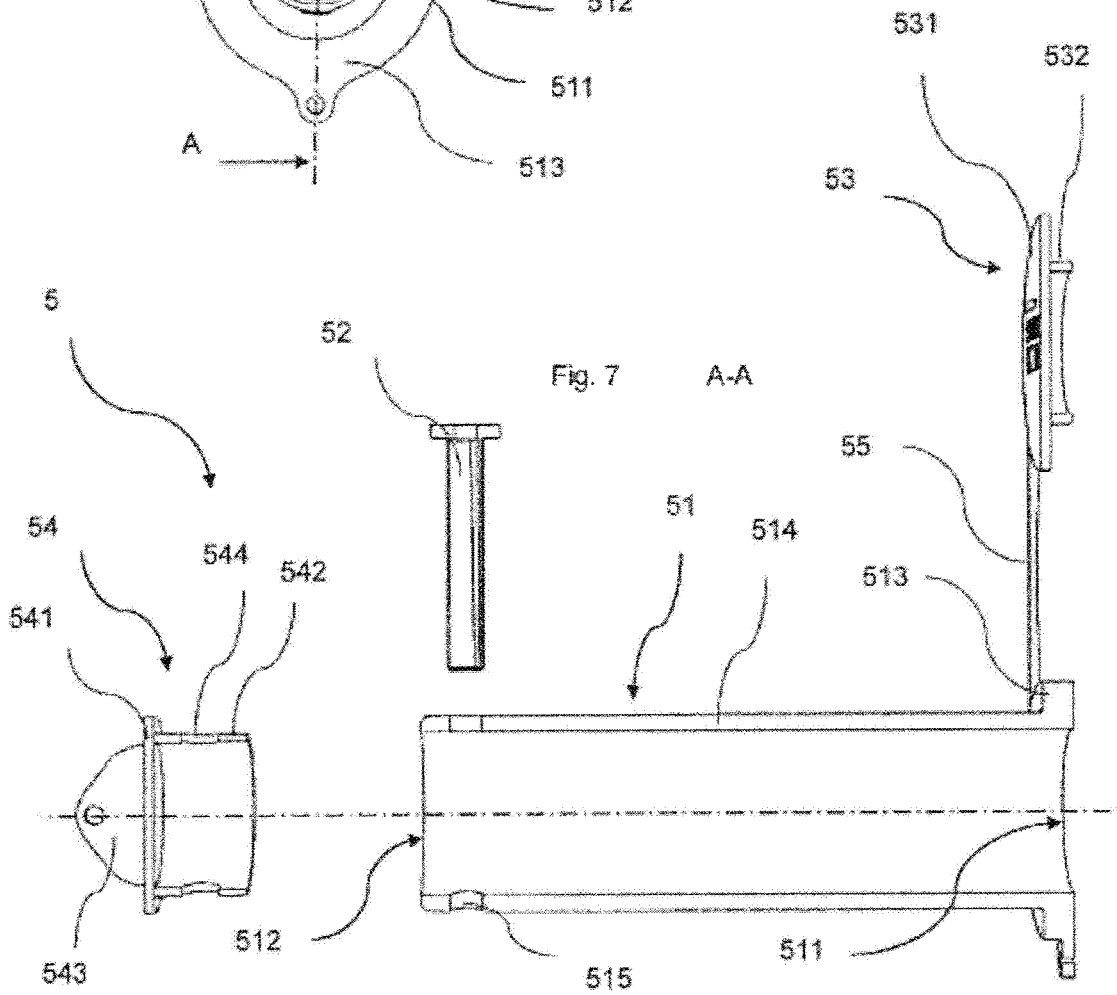
Fig. 7 A-A

ASSEMBLY DEVICE AND SYSTEM FOR AN EXERCISE STRUCTURE, AND ASSOCIATED EXERCISE SYSTEM AND MOUNTING METHOD

CROSS-REFERENCE TO RELATED APPLICATIONS

This application is a continuation of PCT International Application No. PCT/FR2016/053124, filed Nov. 28, 2016, claiming priority of French Patent Application No. FR 1561429, filed Nov. 26, 2015, the contents of each of which are hereby incorporated by reference into the application.

TECHNICAL FIELD

The present invention concerns the general field of training or physical exercise and more specifically the equipment allowing sports exercise such as exercise structures or portal frame.

More specifically, the invention concerns an assembly device intended to assemble an accessory to a sports exercise structure, said structure including at least one hole.

The invention also concerns an assembly system comprising an assembly device as well as a male connector.

The invention also concerns a sports exercise system comprising at least:

a sports exercise structure including at least one hole, an accessory, a male connector, and a device for assembling said accessory to said structure.

The invention finally concerns a method for constructing a sports exercise system comprising a sports exercise structure including at least one hole.

PRIOR ART

In order to facilitate the practice of sports exercise or physical exercise, it is known to use structures in the form of portal frame (also designated by the English term "rack"), which generally allow users, thanks to their modularity, to be able to perform different physical exercises such as for example pull-ups. These known structures include several wooden posts between which can be positioned exercise bars from which users can for example hang (thanks to the strength of the arms in order for example to perform pull-ups). For this purpose, cavities, in which the exercise bars are housed by their ends, are formed in the posts at different heights from the ground.

It is thus possible to vary the height of these exercise bars, and therefore to increase the possibilities of exercises, but also to take into account the morphology of users capable of using them.

These known structures are globally satisfying but still have various disadvantages, in particular from a point of view of the safety of use and the sustainability of the structure.

Particularly, the posts are exposed to a risk of deterioration and wear due to the repeated insertions and extractions of the ends of the exercise bars in the cavities formed in the posts. This risk of deterioration and wear concerns especially the cavities and their vicinity (for example risk of expansion of the cavities and/or deformation of the rims thereof). This may then result in a wear phenomenon and accelerated and premature deterioration of the posts, which can for example be reflected in a deterioration of the paint which might cover the structure, by the appearance of scratches or traces of impacts on the structure.

In addition, there is a risk of dislocation of the exercise bar with these known structures during use, in particular in response to the movements of the user who could thereby fall and get hurt. This risk of accidental extraction of the end of the bar out of the cavity into which it was, may be accentuated by the possible degradation of the connection between the bar and the cavity mentioned above. Indeed, as indicated previously, repeated frictions and impacts will tend to deform and enlarge the cavities and thus to increase the clearance between the bar and the post, thus degrading the quality and reliability of the mechanical connection between the bar and the post.

Another disadvantage of the known structures comes from the large number of cavities made in the posts. Indeed, in order to ensure their modularity and versatility, the designers of these structures have generally equipped them with a cavities/bars ratio much greater than 1. In other words, there are many more cavities, or pairs of cavities than bars, which means that many cavities remain unoccupied (or empty) after installing the exercise bars and when using the structure. Furthermore, the posts of the known structures may also include cut corners in order to make notches intended to accommodate the bars. But these notches then form sharp and cutting protrusions, so that it results in serious risks, in particular from the point of view of safety of the users and sustainability of the structure. Indeed, the users may, in particular inadvertently, or by playing (for example for children), introduce fingers into these cavities and/or notches and thus risk injuries (cut, fracture, etc.).

But these unused holes also represent a risk from the point of view of the sustainability of the structure itself. Indeed, all these unused holes are all entry points for foreign bodies (water, insects, sand, etc.) within the same elements of the structure, and particularly within the posts, compromising then the sustainability of the structure.

These security and sustainability issues then limit considerably the use and deployment of the currently known structures.

Particularly, given the security issues previously mentioned (for example the risk of dislocation of the bars and the risk of finger injury), known structures are generally reserved for an informed public (adult sportsman, for example) so that it is hardly conceivable to install these known structures in public and/or collective (gardens, parks, schoolyards, gyms, etc.) spaces where any user (including children) could have access without specific recommendations and therefore risk injury. Furthermore, given the sustainability issues mentioned previously (for example the penetration of foreign bodies inside the structure), it is hardly conceivable to install these known structures outdoors (gardens, parks, stadiums, beaches, etc.) where many elements (water, snow, sand, insects, etc.) could penetrate inside the structure and prematurely degrade the latter, in particular by rotting.

PRESENTATION OF THE INVENTION

The objects assigned to the present invention therefore aim at overcoming the different disadvantages listed above and at providing a new assembly device intended to assemble an accessory to a sports exercise structure which avoids the premature degradation of said structure and/or said accessory and to improve the safety of use.

Another object of the invention aims at providing a new assembly device that is particularly safe, robust and inexpensive.

Another object of the invention aims at providing a new assembly device that ensures a high security of use.

Another object of the invention aims at providing a new assembly device that allows using the structure outdoors and/or in public places.

Another object of the invention aims at providing a new assembly device that ensures a great comfort of use.

Another object of the invention aims at providing a new assembly device that can be easily replaced, without affecting the structure itself.

Another object of the invention aims at providing a new assembly system intended to assemble an accessory to a sports exercise structure that is particularly robust, reliable and inexpensive.

Another object of the invention aims at providing a new assembly system that is particularly safe.

Another object of the invention aims at providing a new assembly system that ensures an easy and particularly reliable assembly.

Another object of the invention aims at providing a new assembly system that is particularly comfortable to use.

Another object of the invention aims at providing a new sports exercise system that is particularly safe, robust and inexpensive.

Another object of the invention aims at providing a new sports exercise system that is particularly adjustable.

Another object of the invention aims at providing a new sports exercise system that can be used outdoors and in public places.

Another object of the invention aims at providing a new sports exercise system that is particularly easy to modulate.

Another object of the invention aims at providing a new sports exercise system that is particularly comfortable to use.

Another object of the invention aims at providing a new method for constructing a sports exercise structure that is particularly safe, easy to implement and inexpensive.

The objects assigned to the invention are achieved using an assembly device intended to assemble an accessory to a sports exercise structure, said structure including at least one hole, said device being characterized in that it includes at least one hollow main body which extends longitudinally between two ends, which is provided with at least a first opening and which is intended, on the one hand, to be inserted into said hole and, on the other hand, to receive removably a male connector intended to be inserted into said hollow main body through the first opening in order to connect said accessory and hollow main body, said main body delimiting a continuous empty inner volume opening into each end in order to form respectively said first opening and a second opening, and in that the device further comprises a first removable plug intended to seal said first opening when the male connector is not inserted into said hollow main body, and in that the device further comprises a first removable plug intended to seal said first opening when the male connector is not inserted into said hollow main body.

The objects assigned to the invention are also achieved using an assembly system comprising an assembly device as defined previously as well as said male connector.

The objects assigned to the invention are also achieved using a sports exercise system comprising at least:

- a sports exercise structure including at least one hole,
- an accessory,
- a male connector,
- and a device for assembling said accessory to said structure as defined previously, said male connector being intended to be inserted into said hollow main body through the first opening in order to connect said accessory and assembly device.

The objects assigned to the invention are also achieved using a method for constructing a sports exercise system comprising a sports exercise structure including at least one hole, said method being characterized in that it comprises an insertion step in said hole of a hollow main body which is provided with at least one first opening and in that it further comprises either of the following alternative steps:

- a step of sealing said first opening by means of a first removable plug
- or a step of assembling an accessory to said structure, during which a male connector is received removably within said hollow main body by inserting said male connector into the main body through said first opening, in order to connect said accessory to the hollow main body.

DESCRIPTIVE SUMMARY OF THE DRAWINGS

Other particularities and advantages of the invention will appear and emerge in more detail upon reading the following description, with reference to the appended drawings given solely by way of illustrative and non-restrictive example, wherein.

- a single assembly device
- an assembly device that assembles an exercise bar to the post
- an assembly device that assembles a semicircle bracket to the post.

Figure 4:
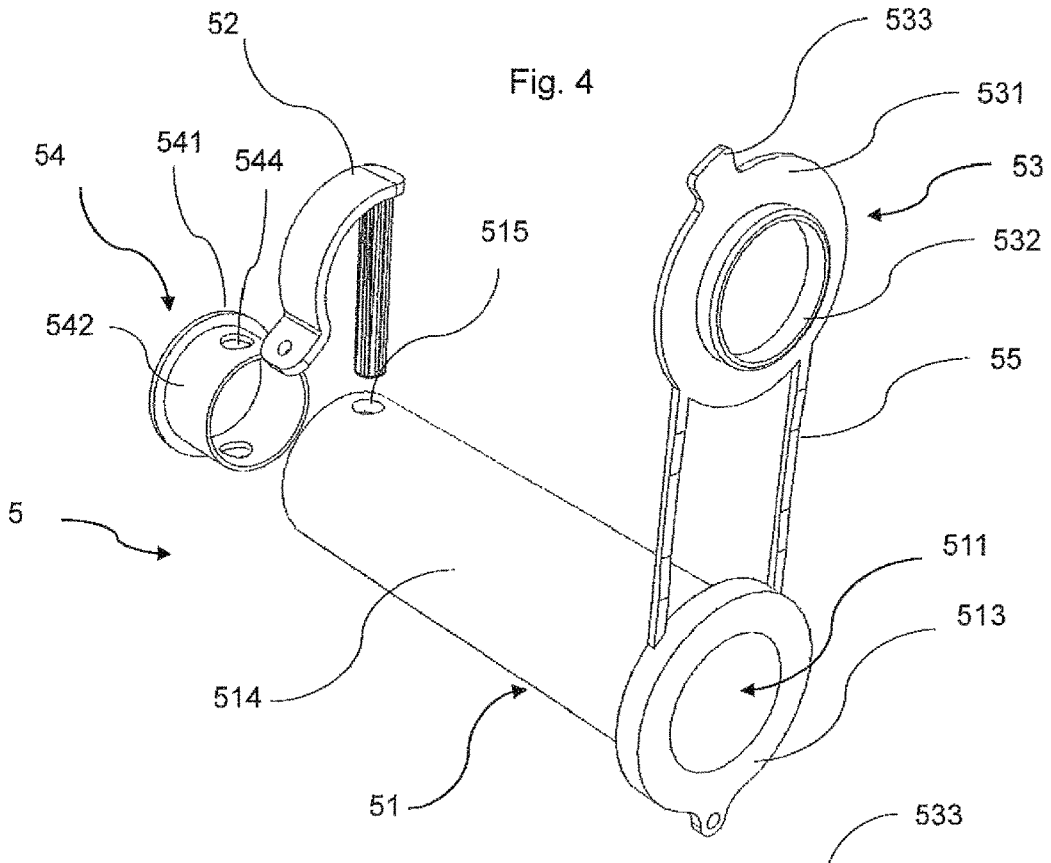

FIG. 4 is an overall perspective view according to a first axis, of an assembly device as defined by the invention.

Figure 5:
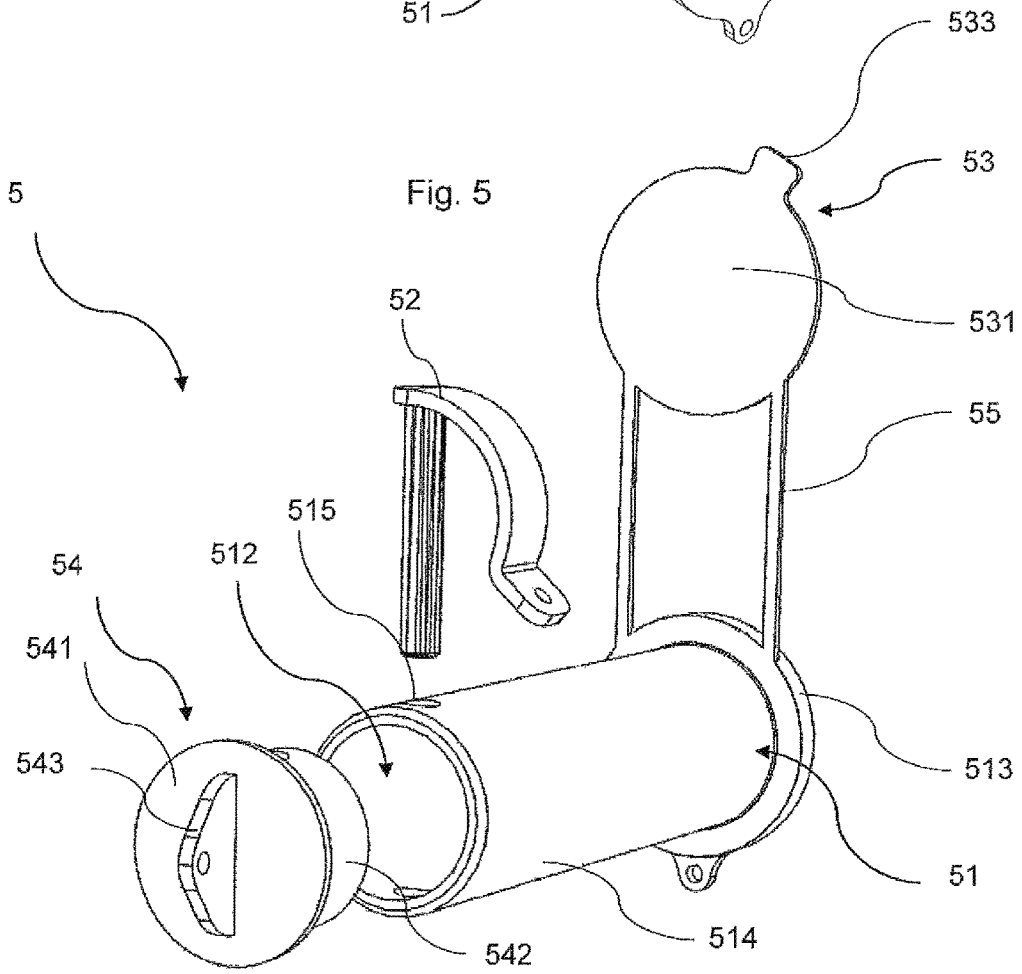

FIG. 5 is an overall perspective view according to another axis, of the assembly device shown in FIG. 4.

FIG. 6 is a front view of the assembly device shown in FIG. 4.

FIG. 7 is a sectional view of the assembly device shown in FIG. 4 according to the axis A-A shown in FIG. 6.

Figure 8:
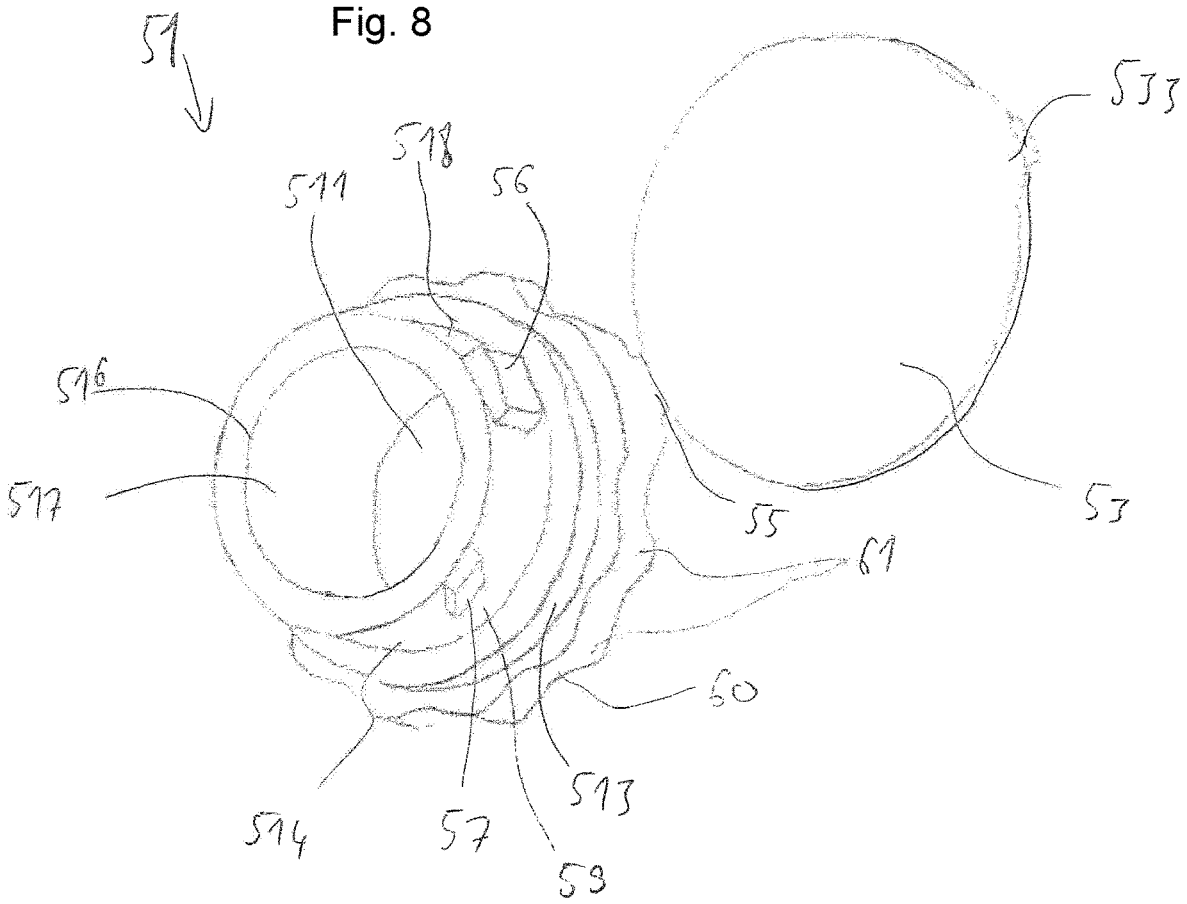

FIG. 8 illustrates, according to a perspective view, a main body which is part of a device in accordance with a particular embodiment of the invention.

Figure 9:
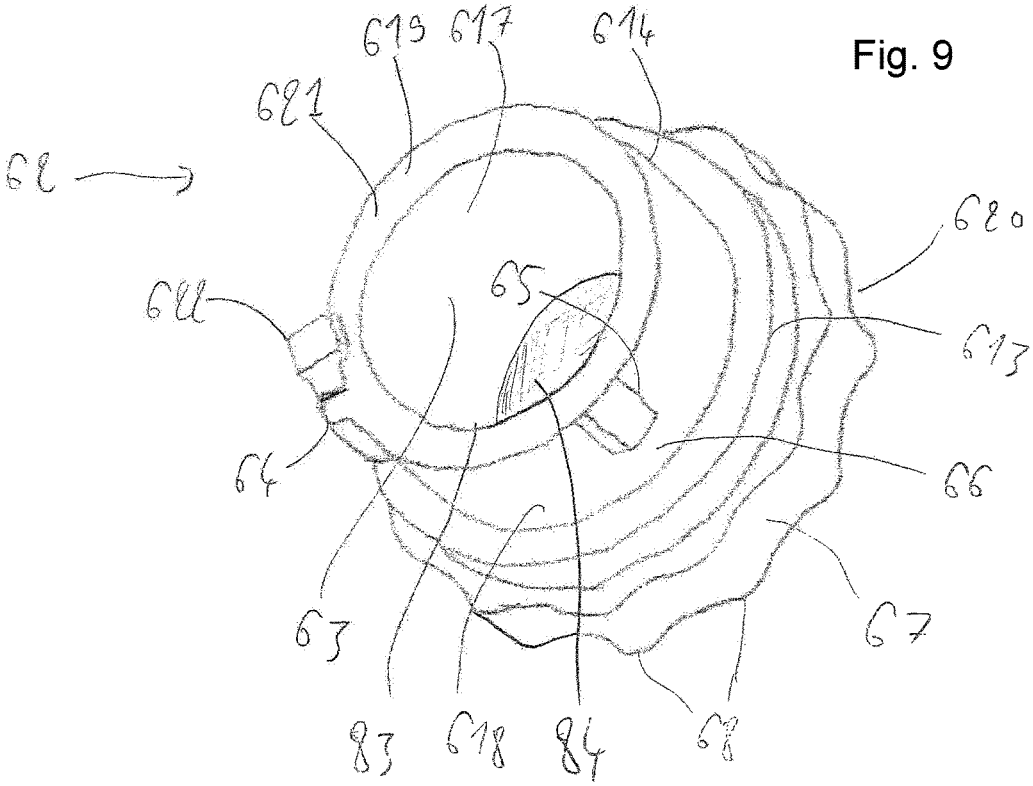

FIG. 9 illustrates, according to a perspective view, a secondary body which is part of a device in accordance with a particular embodiment of the invention.

Figure 10:
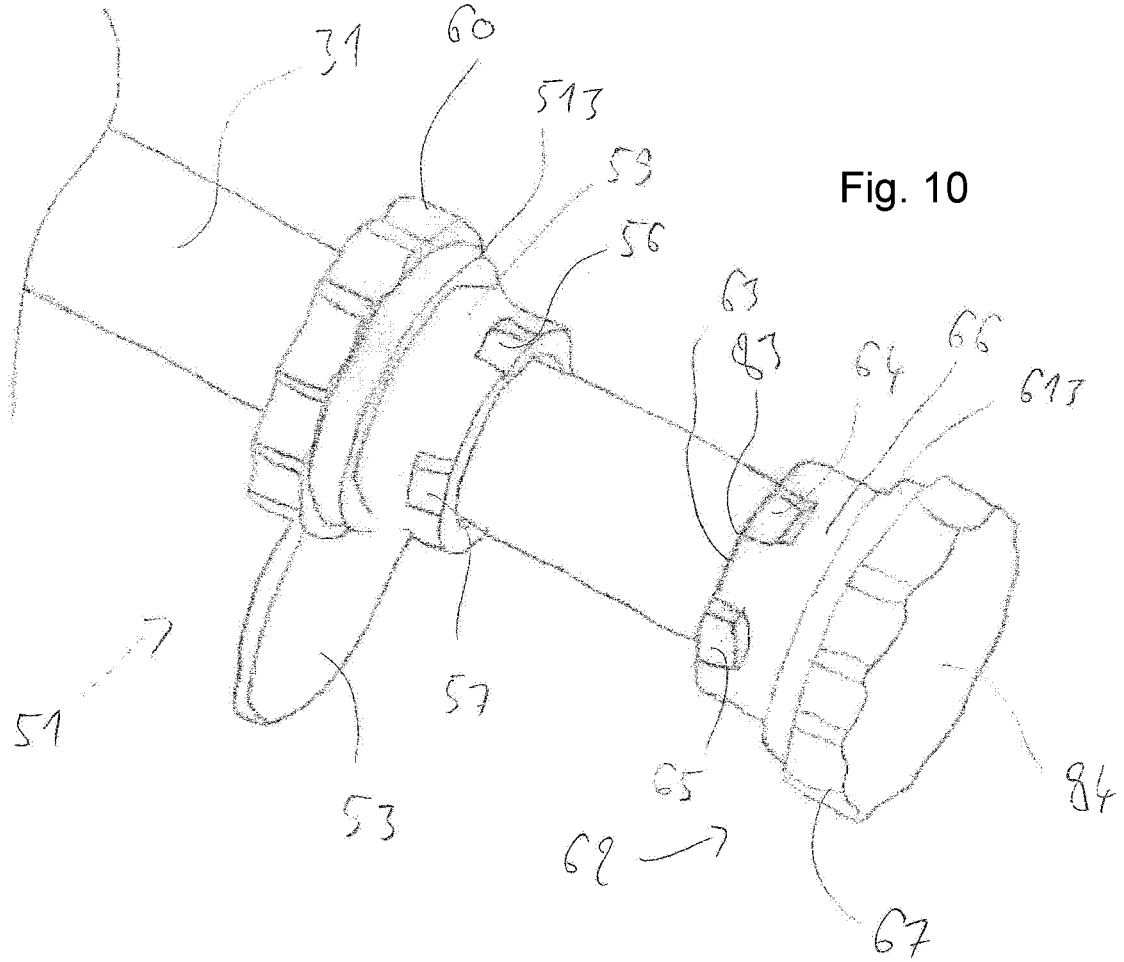

FIG. 10 illustrates, according to a perspective view, a main body and a secondary body which are part of a device according to the invention and which are mounted on an exercise bar.

Figure 11:
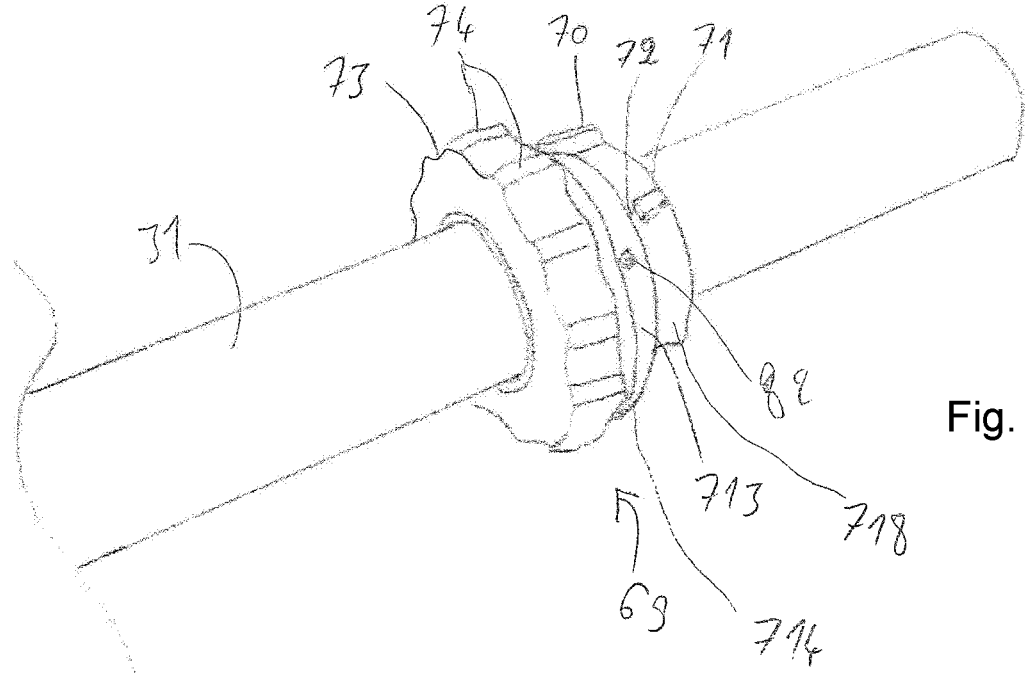

FIG. 11 is a perspective view of a tertiary body mounted permanently, by screwing, on an exercise bar according to a particular embodiment of the invention.

Figure 12:
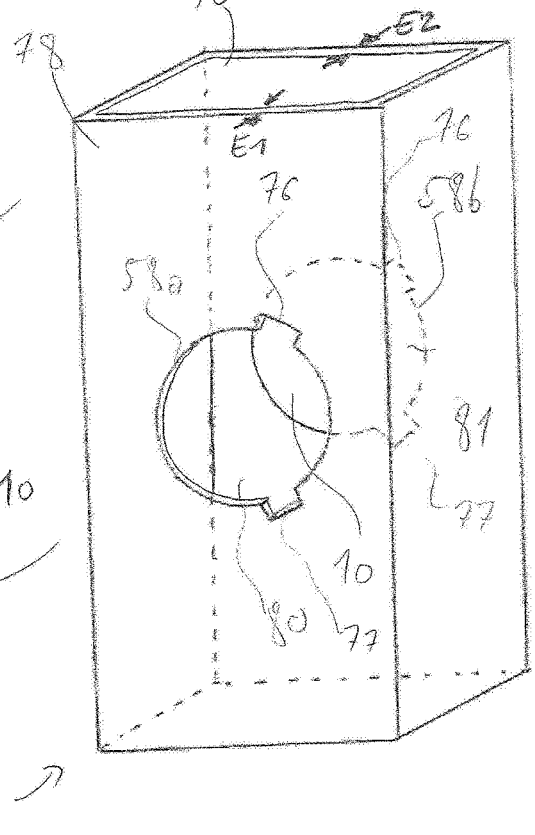

FIG. 12 is a perspective view of a profile portion forming a vertical upright that is part of an exercise system in accordance with a particular embodiment of the invention.

Figure 13:
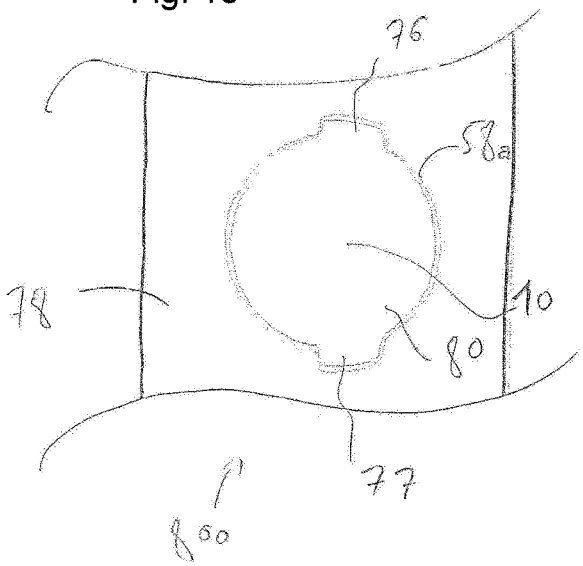

FIG. 13 is an enlarged detail view of the profile of FIG. 12.

Figure 14:
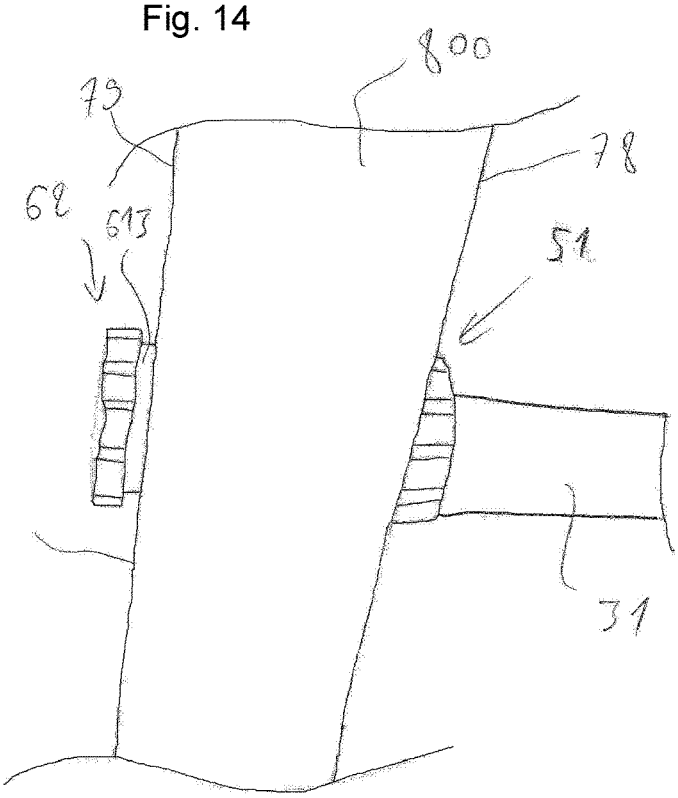

FIG. 14 illustrates, according to a schematic perspective view, the cooperation of a main body and a secondary body of a device according to a particular embodiment of the invention with the left end of an exercise bar engaged in the hole of the profile of FIGS. 12 and 13.

Figure 15:
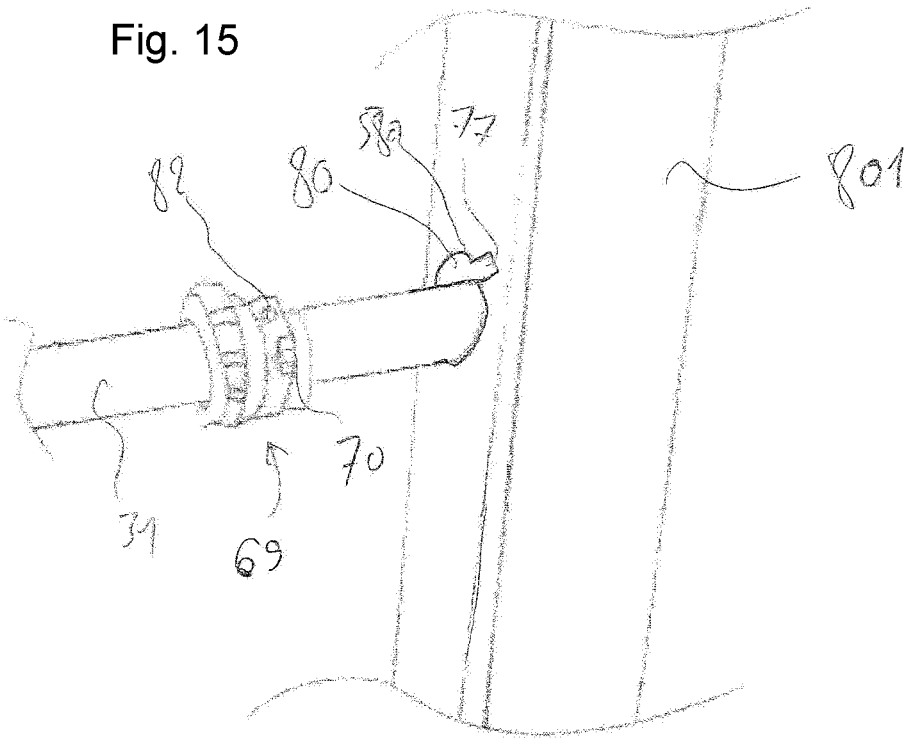

FIG. 15 illustrates, according to a schematic perspective view, the cooperation of a unitary subset formed by the permanent association of a tertiary body and an exercise bar of a sports exercise system according to a particular embodiment of the invention with the hole of a profile in an intermediate position that precedes the final locking position.

Figure 16:
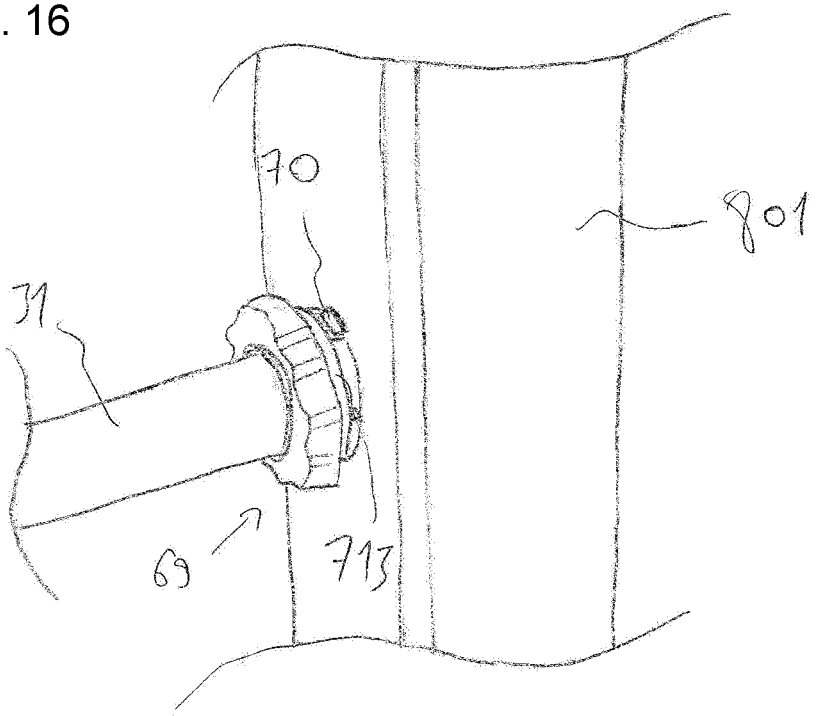

FIG. 16 illustrates, according to a perspective view of the system of FIG. 15, this time with the tertiary body partially inserted into the hole of the profile, in order to block in rotation along a horizontal axis the subset bar/tertiary body relative to the profile forming the upright.

Figure 17:
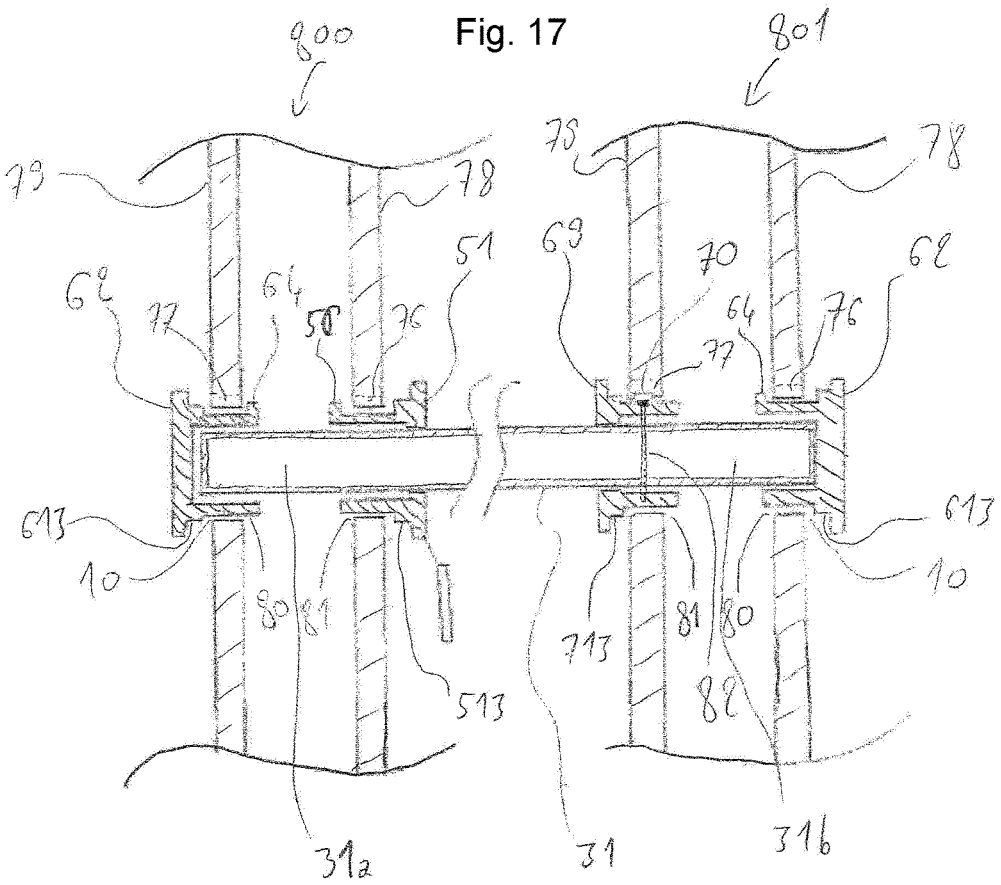

FIG. 17 illustrates, according to a longitudinal sectional view, an embodiment detail of a sports exercise system according to a particular embodiment of the invention, comprising two vertical uprights formed by hollow metal profiles between which is disposed an exercise bar fastened to said uprights by means of a device in accordance with the invention.

Figure 18:
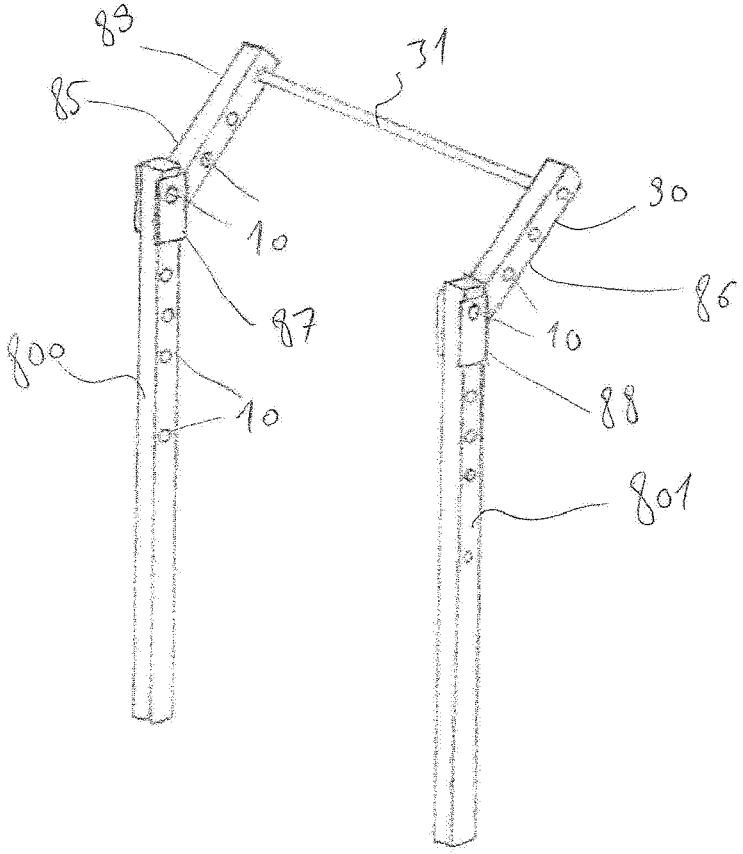

FIG. 18 illustrates, according to a perspective view, a sports exercise structure according to a particular embodiment of the invention.

BEST EMBODIMENT THE INVENTION

Figure 1:
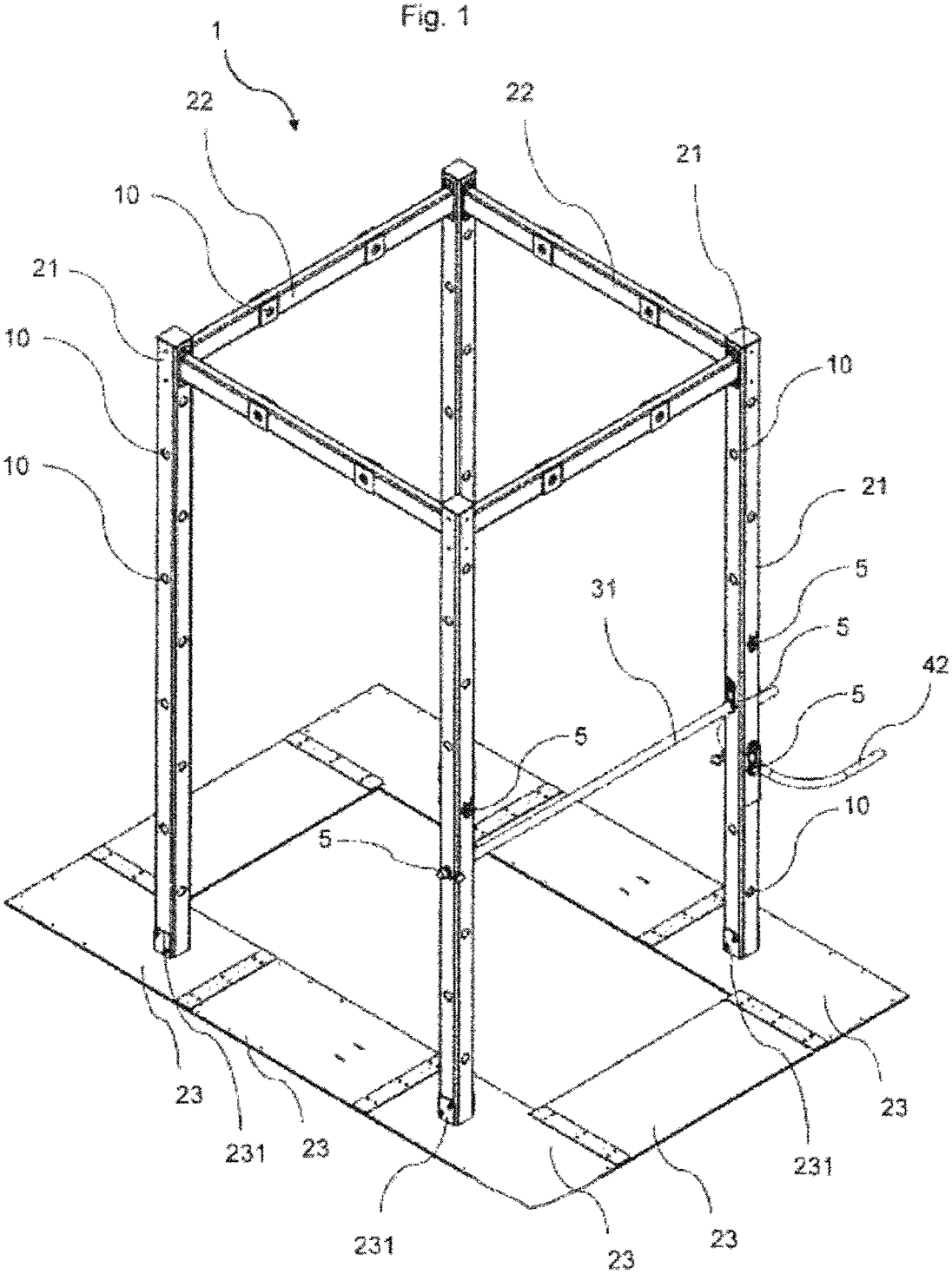
FIG. 1 is an overall perspective view of a sports exercise structure equipped with an assembly device as defined by the invention.

The invention concerns as such an assembly device 5 intended to assemble an accessory to a sports exercise structure 1, as illustrated in particular in FIG. 1. It is meant by "assembly device" any device, means, part or set of parts with the aim of enabling to assemble, that is to say join or mount several elements with each other, in this case, an accessory with a sports exercise structure. Preferably this assembly or this mounting, is non-permanent, that is to say it can be dismounted, advantageously without a particular tool, which makes this operation particularly easy for a user who wishes to change said accessory in order to replace it with another or even to change its location within said structure 1.

"Accessory" may designate any element intended to be assembled or mounted onto the sports exercise structure 1, such as for example an offset bracket, for example intended to provide an extension of said structure 1 or a semicircular bracket 42 for example intended to receive a basketball hoop or to constitute points of support so that a user could perform sports exercises (for example shown in FIG. 1) or any other element that could be mounted onto said first structure 1 and that would allow a user to perform a physical exercise. According to an advantageous embodiment, said accessory is an exercise bar 31, that is to say a bar from which the user can perform a plurality of exercises, with or without accessory elements. For example, the user can simply hang from said bar, in particular in order to perform pull-up exercises, or hang on said bar different elements such as for example straps or elastics, these allowing the user to vary the nature of the exercises (stretching, bending, etc.). Advantageously, said exercise bar 31 has a round cross-section or any other cross-section having good ergonomics, and made of a tough and strong material, preferably to withstand the mechanical stresses generated when a human hangs from said exercise bar, such as stainless steel for example. Preferably, the mechanical flexural strength of said bar is greater than 2000 N.

"Sports exercise structure" designates advantageously a structure, or a portal frame, of sufficient size for allowing a user to perform various physical exercises, in particular pull-ups. In other words, the user is able to hang by the hands, arms outstretched, from said structure 1, the latter being then advantageously of a height of at least 1.50 m, and preferably in the range of 3 m. Advantageously, and as illustrated for example in FIG. 1, said structure 1 includes at least one upright extending longitudinally between a first and a second end. An upright may for example designate a vertical post 21 or a horizontal cross-member 22, that is to say a structure element that allows constructing and holding said structure 1.

Advantageously, said structure 1 is intended to form a fixed frame, for example in the shape of a cage (or compartment) delimited by several uprights, and preferably by several vertical posts 21 (for example four) advantageously disposed at the four corners of a rectangle or a square. The user can then for example be placed inside this frame in order to perform his physical exercises, in particular using the accessory/accessories mentioned previously. Advantageously, said vertical posts 21 are connected to each other two by two, that is to say in pairs, by at least one horizontal cross-member 22 so as to provide said cage with rigidity and strength. Preferably said structure 1 includes four vertical posts arranged to delimit the edges of a rectangular parallelepiped as well as four horizontal cross-members, arranged at the upper ends of said vertical posts so as to constitute four other edges of said parallelepiped, and thus fully participate in the integrity and the mechanical strength of said structure 1. Advantageously, the distance separating said vertical posts is substantially comprised between 1 and 4 m and preferably corresponds to the length of a horizontal cross-member 22, that is to say to substantially 1.5 m. Preferably, said structure defines a cage (or compartment) sufficiently rigid and whose mechanical strength allows at least one user to hang within it.

Preferably, said structure 1 also includes, as a structure element, a base plate 23 (for example shown in FIG. 1) intended to be placed on the ground and to ensure the fixing and the maintenance of a vertical post 21, for example by means of a fixing platen 231 or a fixing bracket. Advantageously, said structure 1 includes a plurality of base plates 23, connected to each other so that the latter contribute to the rigidity and the integrity of said structure 1, by maintaining a fixed gap between the different vertical posts. Furthermore, said base plate 23 allows freeing said structure 1 from the constraints related to the ground and thus allows installing said structure on a multitude of grounds of different nature (grass, gravel, concrete, soil, etc.), since no upright, and particularly no vertical post 21 needs to be fixed directly to the ground. Thus, heavy masonry works (foundations) are avoided thanks to said fixing platens 231 and base plates 23. Advantageously, said base plates 23 are made of a sufficiently strong and heavy material in order to impart a relatively low center of gravity to said structure 1 and thus ensure the stability of the latter. Said base plate 23 may also constitute an invention as such.

In a particularly advantageous manner, it is possible to vary the size of said structure 1 thanks to the number and arrangement of these structure elements. Indeed, it is perfectly possible, for example by adjoining to the structure 1 previously defined (and shown in FIG. 1) other structure elements and in particular other base plates 23, other vertical posts 21 and other horizontal cross-members 22, so as to construct a second cage adjoined (that is to say juxtaposed and connected) to the first cage previously made and described. To do this, it is for example possible to connect to the previous structure 1 (or previous cage) at least two vertical posts 21 for example by means of two horizontal cross-members 22 and a plurality of base plates 23 so to construct a second cage of parallelepiped shape, whose two of the vertical posts are then shared with the first cage. In other words, such an arrangement allows constructing a larger and more complex sports exercise structure 1 defining a plurality of cages, thus increasing the possibilities of use and the number of users capable of using said structure 1 simultaneously. Thus, thanks to these remarkable structure elements, it is advantageously possible, without departing from the scope of the invention, to make a sports exercise structure 1 that is modular (that is to say adjustable), which allows increasing the possibilities of applications and uses of the latter. Indeed, a small size structure (for example providing a single parallelepiped space, or a single cage, as defined previously and shown in FIG. 1) will be particularly suitable and sought by a single user, such as for example a person who wishes to install said structure 1 in his/her yard in order to practice his physical exercises at his home in complete independence and autonomy. Conversely a larger and a more complex structure, that is to say having a plurality of parallelepiped working spaces (or a plurality of cages) will be particularly appreciated as part of a collective and/or public use, such as for example in a park, a square, a stadium, etc. Preferably, the size and the mechanical strength of said structure 1 allows a plurality of users and preferably between 2 and 15 users to be located thereinside and to hang from said structure 1, advantageously by a plurality of exercise bars 31.

According to the invention, said structure includes at least one hole 10 advantageously made in an upright. It is meant by "hole" any cavity, preferably opening cavity (that is to say through cavity), in which an external element can advantageously be introduced. Preferably, said hole 10 has a substantially cylindrical shape and the drilling axis is substantially perpendicular to the surface from which it is made. Advantageously this hole 10 is intended to allow fixing said accessories.

Preferably, said hole 10 is formed transversely through the entire thickness of said upright so as to form a through hole. Said upright may indifferently have a solid or hollow structure and be made of any material sufficiently tough, rigid and strong in order to impart to said structure 1 all its strength and mechanical integrity. For example, said uprights could be formed by wooden beams, or by metal profiles, the latter having advantageously square or round cross-section and preferably hollow cross-section. "Through hole" designates a hole made from side to side of said upright, that is to say completely crossing the latter, and even if the upright has a hollow cross-section (in this case, the hole 10 then crosses at least two thicknesses of materials E1, E2).

Advantageously, said structure 1 includes a plurality of holes 10 preferably distributed in a substantially uniform manner on said structure 1, in order to provide a plurality of possibilities of installations of accessories. Advantageously said holes are made within said upright according to substantially perpendicular drilling axes, and preferably from perpendicular faces of said uprights in the advantageous case where the latter have square cross-section, as shown on FIG. 1. For example, said holes 10 can be separated by a fixed distance (advantageously 600 mm). In this case, preferably, an assembly device 5 is inserted into each of said holes 10 in particular in order, as will be detailed later, not to leave apparent orifices, that is to say holes 10, advantageously in order to prevent any accidental or deliberate introduction of foreign body (water, dust, finger, etc.) inside said structure 1.

Still according to the invention, said device 5 includes at least one hollow main body 51 which extends longitudinally between two ends and which is provided with at least one first opening 511 as illustrated for example in FIGS. 4 to 7. In other words, said main body 51 includes a hole, that is to say a cavity, so as to define a first opening 511.

Said hollow main body 51 is then intended, on the one hand, to be inserted into said hole 10 and, on the other hand, to removably receive a male connector. "Male connector" designates any part whose shape is substantially complementary to that of the recess (or hole) of the hollow main body 51. In other words, said male connector has a shape that allows it to be inserted inside the hollow main body 51 so as to perform an assembly.

Advantageously, said accessory forms at least in part said male connector. In other words, according to an advantageous embodiment, the accessory, and preferably an exercise bar 31 as defined previously is introduced preferably through one of its ends, inside the hollow main body 51, the latter being itself introduced inside the hole 10 of the sports exercise structure 1. Thus, said physical exercise bar 31 (which forms in this case the accessory) is not in direct contact with the sports exercise structure 1, since it is assembled to the latter by means of the assembly device 5. In other words, the hollow main body 51 is an intermediate part located between the accessory and the sports exercise structure 1, which allows imparting to the assembly remarkable properties and in particular in terms of sustainability and comfort since the accessory, and particularly the exercise bar 31 is not in direct contact with the structure 1, thereby avoiding any scratch, friction, or even noise issues known in the prior art structures.

Advantageously, said male connector is secured to said accessory, and is preferably integrally formed with the latter. In other words, said connector is integrated into said accessory and preferably materially integral with the latter, that is to say the connector is made of the same material and advantageously during the same manufacturing process as said accessory. Thus, according to a particular embodiment, said accessory may, for example, designate an exercise bar 31 that would include, at each of its ends a specific shape that allows it to be similar to the male connector defined previously.

Alternatively, a fixing shaft 32 forms said male connector, the latter being then advantageously used for fixing a specific accessory, for example an offset bracket or a semi-circular bracket 42 mentioned previously, on said sports exercise structure 1. More precisely, according to this particular embodiment, and shown for example in FIG. 3, said specific accessory has substantially the shape of a bracket whose part forms advantageously a complementary recess of the shape of said upright on which it is intended to be mounted. Advantageously, said upright is a vertical post 21 of a substantially square cross-section and the bracket includes then a U-shaped portion intended to be placed around said vertical post 21. Preferably, this U-shaped portion includes a through hole made advantageously through the two opposite walls of the U, this hole being intended to accommodate the fixing part 5. Preferably, in order to increase the rigidity of said connecting part 5, a fixing shaft 32 is placed inside the latter, so as to play the role of the male connector defined previously. Indeed, the stresses applied on the specific accessory are transmitted to the structure 1 through the fixing part 5, but the rigidity and the mechanical strength of the latter has been then considerably increased thanks to said fixing shaft 32 which thus fills the hole of the hollow main body 51.

Thus, according to the invention, said male connector is intended to be inserted into said hollow main body 51 through the first opening 511 in order to connect said accessory and hollow main body 51. In other words, a joint, and advantageously an fixed joint as will be detailed subsequently, is performed between said accessory and the hollow main body 51 thanks to the male connector, the latter being advantageously usable directly as a connecting part and/or as a reinforcing part.

Advantageously, the hollow main body 51 comprises:

- a tubular side wall 514 extending between said first opening 511 and a second opening 512, "tubular side wall" refers then preferably to a spacer whose shape is substantially that of a tube,
- and a shoulder 513 located at said first opening 511, "shoulder" designating advantageously a diameter increase preferably intended to serve as a support. Preferably, during the insertion of the main body 51 into the hole 10, said shoulder 513 abuts against said upright, so as to immobilize in translation the hollow main body 51 within said upright. Advantageously, the outer diameter of the shoulder 513 is comprised between 20 and 90 mm and is preferably equal substantially to 55 mm. Preferably the thickness of said shoulder 513 is comprised between 2 and 20 mm and is substantially equal to 5 mm.

Preferably the main body 51 has a cylindrical tube shape of circular cross-section extending longitudinally between two ends. Preferably, the main body 51 delimits a continuous internal empty volume opening at each end in order to form respectively said first and second openings 511, 512. Said hollow main body 51 preferably has a shape of revolution, and advantageously a substantially cylindrical shape, said first and second openings 511, 512 being then located on each of the opposite planar faces of the cylinder, so as to define a hollow cylinder, that is to say a tube. In this preferred case, said first and second openings 511, 512 therefore have the shape of a disk defining each the openings of said tube. Advantageously, the diameter of said main body 51 is fitted to that of said hole 10, so that the main body 51 can be inserted into said hole 10 and advantageously remain there. Preferably, the fit in question is a clearance fit, that is to say it allows inserting and/or removing said main body 51 from the hole 10 without excessive effort while ensuring proper centering and guiding of said main body. In other words, the outer diameter of the hollow main body 51 substantially corresponds (with a functional clearance for the insertion and/or extraction of said body) to the diameter of the hole 10. Advantageously, the outer diameter of the main body 51 is substantially comprised between 20 and 60 mm and preferably substantially equal to 42 mm.

In the preferential case described above where the hollow main body 51 has substantially the shape of a tube, the male connector will then have a substantially complementary cylindrical shape so as to be able to be inserted inside the tube, and this in order to advantageously achieve a sliding pivot connection (a cylinder inside a cylindrical hole). Advantageously, the inner diameter of the hollow main body 51 is substantially equal to the diameter of said male connector and is substantially comprised between 10 and 60 mm and preferably substantially equal to 35 mm.

Figure 2:
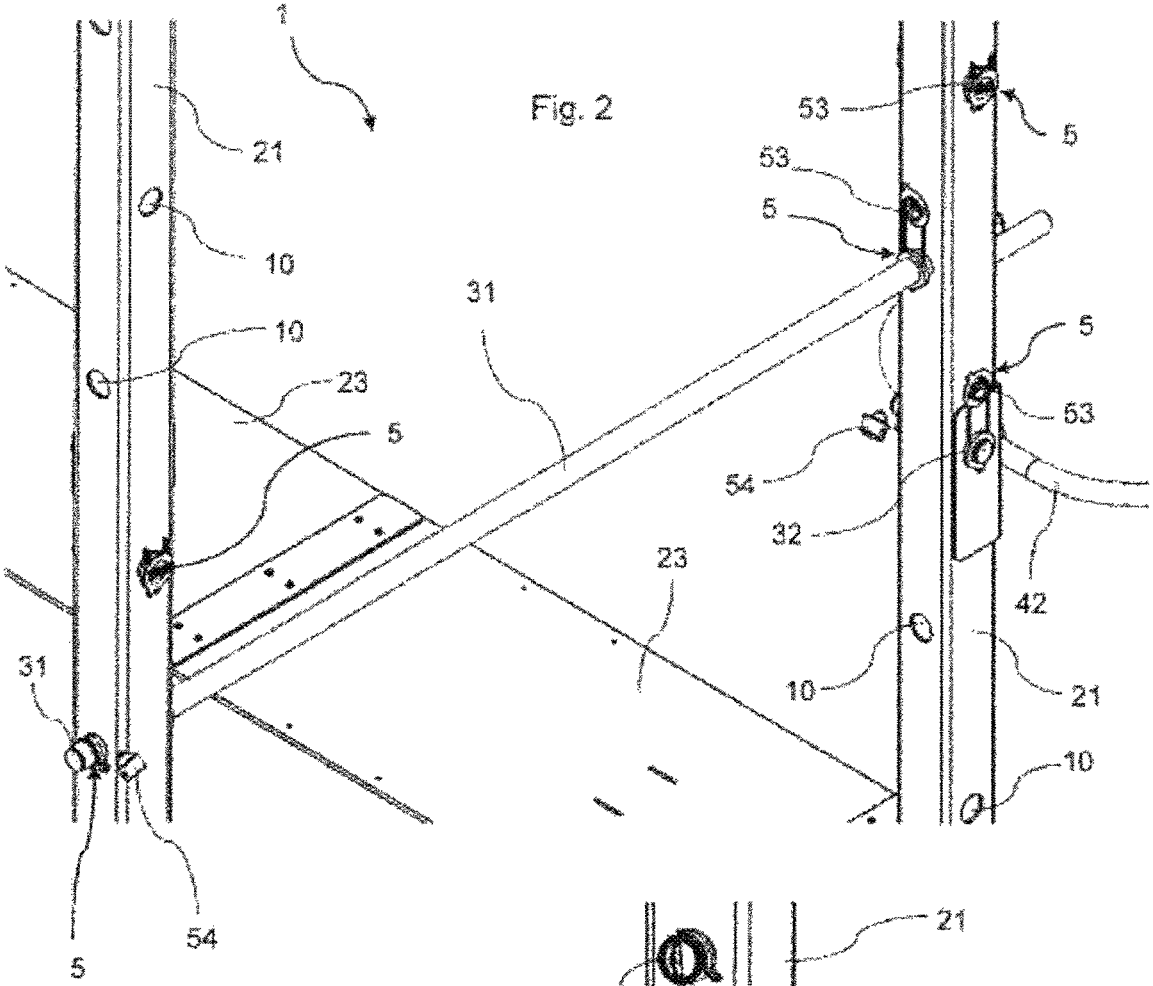
FIG. 2 is a detailed and perspective view of accessories (an exercise bar and a semicircular bracket) mounted on the sports exercise structure shown in FIG. 1 by means of assembly devices as defined by the invention.
Figure 3:
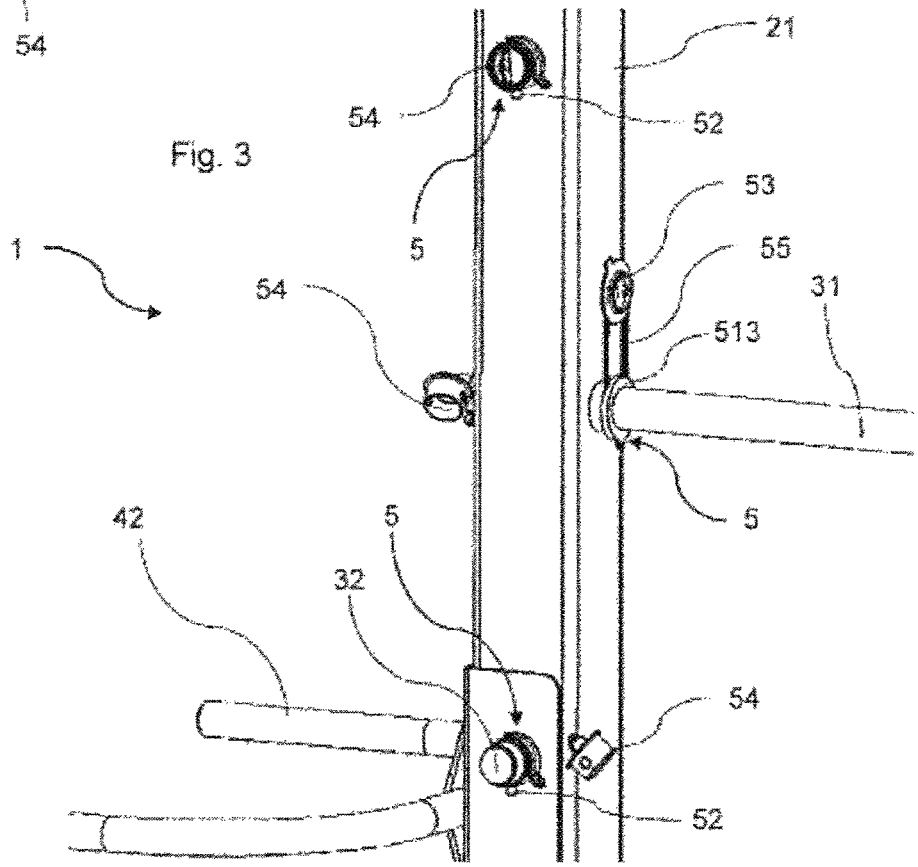
FIG. 3 is a detailed and perspective view (according to another axis) of a vertical post of the sports exercise structure shown in FIG. 2, said post including a plurality of assembly devices as defined by the invention and in particular, from top to bottom.

Preferably, said hollow main body 51 is dimensioned so as to protrude from each side of the upright, as shown for example in FIG. 2 or 3. In other words, the length of the hollow main body 51 is greater than the thickness (or the cross-section) of said upright, so that a portion of the hollow main body 51 protrudes from each side of said upright. Advantageously, the total length of the hollow main body 51 is comprised between 50 and 400 mm and preferably between 100 and 200 mm.

Preferably, the hollow main body 51 is made of plastic material, and is preferably made by injection/molding of plastic material, or by any other method allowing to implement quickly, with high reproducibility and at a lower cost one plastic part within a mold intended to give it its final shape. Furthermore, the hollow main body 51 and by extension the assembly device may constitute a wear part, that is to say a part intended to wear before the other parts, and advantageously before said structure 1 itself and before said accessory. Indeed, it is better for the user of the structure 1 or its owner to replace easily the assembly device 5 that is an inexpensive part of a small size rather than changing a structure element, such as for example a vertical post 21 or a horizontal cross-member 22, these elements being much more bulky, difficult to replace and expensive.

According to the invention, the assembly device 5 further comprises a first removable plug 53 intended to seal said first opening 511 when the male connector is not inserted into said hollow main body 51. "Plug" preferably designates any device whose main function is to plug, that is to say, to conceal or obstruct an opening and in this case the first opening 511 defined previously. The shape of the first plug 53 is then substantially complementary, at least over some portion thereof, to the shape of the recess (or the hole) of said hollow main body 51. Advantageously, and as illustrated for example in FIGS. 4 to 7, said first plug 53 includes a first outer disk 531 whose diameter is substantially greater than that of said first opening 511 so as to completely conceal the latter while putting the plug in place.

Said plug being removable, it is therefore advantageously provided to be put in place and taken off at will, that is to say so as to plug or unplug said first opening 511 at will. Preferably, these plugging and unplugging operations can be performed without a specific tool and with bare hands by a user. In a particularly advantageous manner, said first removable plug 53 is in particular put in place when the inside of the hollow main body 51 remains unoccupied, that is to say when there is no male connector thereinside. Said plug includes advantageously a first tongue 533, that is to say a protrusion, which protrudes, preferably in a centrifugal direction, from the first outer disk 531.

Preferably, the diameter of the first outer disk 531 is less than or equal to and advantageously equal to that of said shoulder 513, so that said first outer disk 531 covers, in addition to the first opening 511, the apparent surface formed by said shoulder 513. In this case, only the first tongue 533 then protrudes from the shoulder 513 which allows easily a user to grasp said plug 53, in particular for taking it off.

Preferably, said first plug 53 also includes a first ring 532 adjoined to said first outer disk 531 and intended to cooperate with the first opening 511 of the hollow main body 51. In other words, this first ring 532 protrudes from the first outer disk 531, so as to be inserted inside said hollow main body 51 when the plug is put in place in the first opening 511. Advantageously, the outer diameter of this first ring 532 substantially corresponds (with a slight functional clearance) to the diameter of said first opening 511 so as to be introduced in the latter. Thus, when the plug is in place on the first opening 511, the first outer disk 531 is supported on the main hollow body 51, preferably is supported on the surface of the main hollow body 51 and advantageously of the shoulder 513, while the first ring 532 is inside the hollow main body 51, advantageously in an annular contact. Said first ring 532 may be indifferently made during the same manufacturing process as said first outer disk 531 (in particular by machining or molding operation for example) by being integrally formed with the latter or on the contrary by being added onto said disk, for example by a well-known assembly process as such, such as for example a gluing or welding process.

Advantageously, said first plug 53 is made of a relatively flexible material (such as for example of silicone or rubber), and advantageously substantially more flexible than the one of which the hollow main body 51 is made, so as to deform slightly when it is placed, thus ensuring an optimal sealing. More precisely, it is advantageously the first ring 532 which deforms slightly during its introduction into the first opening 511 of the hollow main body 51 in order to optimize the sealing, and in particular in order to ensure waterproof and dustproof. Moreover, this slight deformation allows keeping the plug in place and preventing it from being accidentally taken off, for example under the effect of the wind or of a slight impact.

Thus, the first removable plug 53, advantageously including the two portions defined previously (the first outer disk 531 and the first ring 532), is remarkably adapted to be partially inserted inside the hollow main body 51 of the assembly device, and this so as to plug, that is to say conceal, the first opening 511, and preferably when no male connector is located inside said hollow main body 51. This first removable plug 53 allows then preventing a foreign body (such as dirt, water, or the finger of a user) from penetrating inside the assembly device 5.

Indeed, when the assembly device 5 is not used, or used only partially, that is to say in particular when it is positioned in a hole 10 of the structure 1 but does not include, within its hollow main body 51, a male connector, the first removable plug 53 described previously advantageously allows sealing the first opening 511, for sustainability reasons (water cannot penetrate inside the structure 1), and/or safety reasons (a user cannot introduce his fingers inside). Conversely, when a male connector is located inside the hollow main body 51, the orifice of the latter is already sealed (by said male connector) which makes the use of said first plug unnecessary, or the use of the latter even incompatible since it is quite possible and even preferable that the length of the male connector is substantially greater than the length of the hollow main body 51.

Preferably, the assembly device comprises a substantially flexible link 55 connecting said first removable plug 53 to said main body 51, that is to say said first plug 53 is fastened by a link 55 to said main body 51, in order to keep a user from loosing said plug when the latter is not used for sealing the first opening 511, as described previously. In other words, said first removable plug 53 is connected, that is to say fastened by a link 55, to said main body 51. "Link" designates here any element that allows connecting one element to another, while maintaining a relative freedom of motion between the two elements. Thus, a link could for example be used implementing a substantially flexible element such as a rope, a wire or a chain. Preferably, said link 55 may be constituted by a substantially flexible strip made of the material constituting said first plug (silicone or elastic for example). Advantageously, said first plug 53 is connected to the main body 51 by a plurality of links 55, and preferably two, in order to limit the risk of loss of said plug in case of rupture of one of said links.

Advantageously, the main body 51 is integrally formed with the first plug 53 and the link 55, that is to say these three elements are advantageously produced during the same process (for example plastic injection or molding process) and are all three connected together by the same material.

Advantageously, said hollow main body 51 extends longitudinally between said first opening 511 and an opposite second opening 512 and the assembly device 5 further comprises a second removable plug 54 intended to seal said second opening 512, according to a principle and an operation substantially similar to that of the first removable plug 53 with the first opening 511 defined previously. Preferably, just like the first removable plug 53 defined previously, the second removable plug 54 includes a second outer disk 541 whose diameter is substantially greater than that of said second opening 512 so as to completely conceal the latter when putting the second plug 54 in place. The shape of the second plug 54 is then substantially complementary, at least over some portion thereof, to the shape of the recess (or hole) of said hollow main body 51.

Said second plug 54 being removable, it is therefore advantageously provided to be put in place and taken off at will, that is to say so as to plug or unplug said second opening 512 at will. Preferably, these plugging and unplugging operations can be performed without a specific tool and with bare hands by a user. To do this, said plug advantageously includes, and in the same pattern as the first plug 53, a second tongue 543, that is to say a protrusion, that protrudes, preferably in an axial direction, from the second outer disk 541. Said tongue is then particularly adapted to take off or put in place said plug by providing a contact surface which can be easily gripped by the fingers of a user.

Preferably, said second plug 54 also includes a second ring 542 adjoined to said second outer disk 541 and intended to cooperate with the second opening 512 of the hollow main body 51. In other words, said second ring 542 protrudes from the second outer disk 541 and preferably in a direction opposite to that of said second tongue 543. Advantageously, the outer diameter of this ring 542 substantially corresponds (with a slight functional clearance advantageously similar to that defined previously for the first plug 53) to the diameter of said second opening 512 so as to be introduced into the latter. Said ring 542 may indifferently be made during the same manufacturing process as said second outer disk 541 (in particular by machining or molding operation for example) and is then integrally formed with the latter or on the contrary added onto said disk, for example by a well-known assembly process as such, such as for example a gluing or welding process.

Advantageously, said second plug 54 can also be fastened by another link to said main body 51 and/or to the fastening element 52 defined below.

Said device 5 advantageously comprises a fastening element 52 designed to removably fasten the male connector to said main body 51. In other words, said fastening element 52, or fixing element, is intended to immobilize said male connector within said hollow main body 51, and thus lock or block the assembly. "Fastening element" advantageously designates any well-known device as such, whose main function is advantageously to immobilize one part relative to another at least in one direction. Thus, said fixing element 51 is preferably chosen from the group including the screws, the pins, the stop rings (or "circlips"), the keys, etc. Preferably, said fixing element is formed by a pin and advantageously a cylindrical pin or a "jumper" type pin so as to be mounted and dismounted at will and without tools or special efforts.

This fixing element is therefore intended to interact between said male connector and said main body 51 so as to immobilize, that is to say prevent movement of the accessory within the hollow main body 51, and this according to at least one direction, and in particular by blocking the translation along the main axis of said hollow main body 51. In the preferential case presented above, where the male connector and the hollow main body 51 form a sliding pivot connection, the fastening element 52 then at least immobilizes the translation of said connection to make a pivot connection, leaving thus possible only the rotation of the male connector within the hollow main body 51.

Advantageously, the main body 51 comprises a tubular side wall 514 comprising a first orifice 515 and the fastening element 52 comprises a pin intended to be threaded both into said orifice 515 and an orifice arranged in the male connector. In other words, said fastening element 52 allows making a fixed joint, that is to say it allows blocking all the possible movements between the male connector and the hollow main body 51. To do this, and according to a preferred embodiment, on the one hand, said connector includes in a radial direction a through hole in which said fastening element 52, for example a pin, is intended to be inserted. On the other hand, the hollow main body 51 also includes, in a radial direction, a first through orifice 515, advantageously made radially through the tubular side wall 514 and also intended to receive said fastening element 52. Consequently, the latter crosses both the hollow main body 51 and the male connector which allows to fully immobilize the latter within the hollow main body 51 and thus to create a fixed joint. Advantageously, the diameter of said first orifice 515 is comprised between 2 and 20 mm and is substantially equal to 8 mm, so as to correspond substantially to that of the fastening element 52.

Advantageously, said fastening element 52 may be connected to the hollow main body 51, for example by means of a substantially flexible link such as a rope or a chain.

Preferably, said fastening element 52 is also designed to fasten removably said second plug 54 to said main body 51. In other words, said second plug 54 interacts with the fastening element 52, the latter being advantageously located close to the second opening 512. In other words, in addition to advantageously cross the hollow main body 51 and the male connector as previously defined, the fastening element 52, preferably consisting of a pin, also crosses preferably the second removable cap 54, in particular via a second orifice 544, advantageously made radially in the second ring 542. Thus, when the second removable plug 54 and the fastening element 52 are in place, it is no longer possible to take off said second plug 54. In other words, in order to be able to remove the second removable plug 54, first, it is first necessary to remove the fastening element 52. Thus, the second plug 54 comprises a second orifice 544, and the pin is intended to be threaded both into said second orifice 544 and into the orifice arranged in the male connector and in the first orifice 515 arranged in the side wall 514. Advantageously, the diameter of said second orifice 544 is comprised between 2 and 20 mm and is substantially equal to 8 mm, so as to correspond to that of the fastening element 52.

The foregoing description concerns more specifically the embodiments of FIGS. 1 to 7.

The particular embodiments of the invention illustrated in FIGS. 8 to 18 will now be described. These embodiments differ essentially from those previously described by the design of the assembly device which advantageously includes several separate and independent parts as described in more detail below. That being so, the foregoing description remains valid, for the common parts, with regard to the embodiments described in detail below, in particular with regard to the exercise structure and the accessories.

In these modes, the assembly device 5, as illustrated in FIG. 8, includes at least one hollow main body 51 close to that illustrated in FIG. 4, with the difference that the assembly device does not comprise, in this particular embodiment, a second plug 54 or a fastening element 52 or an orifice 515 in the tubular side wall 514 of the hollow main body 51 as described above. However, the already described other elements are present.

Thus, the assembly device 5 intended to assemble an accessory to a sports exercise structure 1, said structure including at least one hole 10, includes at least one hollow main body 51 which extends longitudinally between two ends, which is provided with at least a first opening 511 and which is intended, on the hand, to be inserted into said hole 10 and, on the other hand, to removably receive a male connector intended to be inserted into said hollow main body 51 by the first opening 511 in order to connect said accessory and hollow main body 51, said main body 51 delimiting a continuous empty inner volume opening at each end to form respectively said first opening 511 and a second opening 516, and the device further comprises a first removable plug 53 intended to seal said first opening 511 when the male connector is not inserted into said hollow main body 51.

Preferably, the main body 51 comprises a tubular side wall 514 having an inner surface 517 intended to face the male connector and an opposite outer surface 518, as well as at least one lug 56, 57 which protrudes from the outer surface 518. More preferably, the cross-section of said tubular side wall 514 is of circular or oval shape. Even more preferably, the main body 51 has a cylindrical tube shape of circular or oval cross-section. Said lug 56, 58 will allow making said main body 51 secured to said structure 1, thus contributing to the stability of the exercise system.

Advantageously, the main body 51 comprises at least two lugs 56, 57 which protrude from the outer surface 518 and which are not located on the same diameter of said circular or oval cross-section. This allows improving the securing of said structure 1 to the main body 51, in particular by avoiding that a simple 180° turn of the main body along the horizontal (that is to say along its longitudinal axis) is sufficient to separate the main body 51 from the structure 1.

Preferably, the hollow main body 51 comprises a shoulder 513 which protrudes from said outer surface 518 and which is intended to abut against a rim 58 of said hole 10 of said structure 1. More preferably, each lug 56, 57 is at a distance from said shoulder 513 to provide an interstitial space 59 between the lug 56, 57 and the shoulder 513.

Advantageously, the main body 51 comprises a gripping thumbwheel 60, said thumbwheel 60 being preferably formed by teeth 61 located on the circumference of the outer surface 518 of the main body 51.

Advantageously, the hollow main body 51 is not long enough to cross an upright of the structure 1, through a hole 10, said upright may be a metal profile, a wooden beam, etc. as previously described.

Alternatively, as illustrated in FIG. 9, the assembly device 5 also comprises at least one hollow secondary body 62 which extends longitudinally between two ends, which is distinct from and independent of the hollow main body 51 and provided with a blind orifice 63, and which is intended, on the one hand, to be inserted into said hole 10 and, on the other hand, to removably receive within the blind orifice 63 a free end of said male connector to connect said accessory and hollow secondary body 62.

Preferably, the secondary body 61 comprises a tubular side wall 614 having an inner surface 617 intended to face the male connector and an opposite outer surface 618, as well as at least one lug 64, 65 which protrudes from said outer surface 618. More preferably, the cross-section of said tubular side wall 514 is of circular or oval shape. Even more preferably, the main body 51 has a cylindrical tube shape of circular or oval cross-section. Said lug 64, 65 will allow to make said secondary body 62 secured to said structure 1, thus contributing to the stability of the exercise system.

Advantageously, the secondary body 69 comprises at least two lugs 64, 65 which protrude from the outer surface 618 and which are not located on the same diameter of said circular or oval cross-section. This allows improving the securing of said structure 1 to the secondary body 62, in particular by avoiding that a simple 180° turn of the main body according to the horizontal (that is to say along its longitudinal axis) is sufficient to separate the secondary body 62 from the structure 1.

Preferably, the hollow secondary body 62 comprises a shoulder 613 which protrudes from said outer surface 618 and intended to abut against a rim 58 of said hole 10 of an upright of said structure 1. More preferably, each lug 64, 65 is located at a distance from said shoulder 613 to provide an interstitial space 66 between the lug 64, 65 and the shoulder 613.

Advantageously, the secondary body 62 comprises a gripping thumbwheel 67, said thumbwheel 67 being preferably formed by teeth 68 located on the circumference of the outer surface 618 of the secondary body 62.

Very preferably, the diameter of said secondary body 62 is fitted to that of a hole 10 of said sports exercise structure 1.

Advantageously, said tubular wall 614 of said hollow secondary body 62 extends longitudinally between a front face 619 and a rear face 620, the front face 619 forming a rim 621 delimiting the opening of said blind orifice 63 of said hollow secondary body 63, the rear face 620 being closed to form the blind orifice 63, and a hook 622 protrudes from said front face 619, said hook 622 being preferably integral with the secondary body 62.

As illustrated in FIG. 10, the main body 51 and the secondary body 62 can thus be threaded on an accessory and particularly a preferably substantially cylindrical exercise bar 31 so that a portion of said bar 31 protrudes on either side from the main body 51, and that one end of said bar 31 passes a first end of the secondary body 62 comprising the opening 83 of said blind orifice 63 and abuts against the bottom 84 of said blind hole 63, the bottom being located at a second end of the secondary body 62. In other words, said bar 31 passes right through said main body 51 in its longitudinal direction, and the secondary body 62 caps one end of the bar 31. In other words again, the main body 62 is threaded onto the bar 31. In FIG. 10, the exercise structure 1 enabling the support of the bar 31 and of said main 51 and secondary 62 body is not shown.

Alternatively, as illustrated in FIG. 11, the assembly device 5 further comprises a hollow tertiary body 69 which extends longitudinally between two ends, which is distinct from and independent of the main 51 and secondary 62 body, which delimits a continuous empty inner volume opening at one end, and which is intended, on the one hand, to be inserted into one of said holes 10 and, on the other hand, to receive an exercise bar 31 intended to be inserted into said hollow tertiary body 51 in said continuous inner volume in order to connect said bar and hollow tertiary body 69. In this alternative, an end portion of the exercise bar 31 constitutes said male connector, and the exercise bar 31 constitutes said accessory.

Preferably, the tertiary body 69 comprises a tubular side wall 714 having an inner surface 717 intended to face the exercise bar 31 and an opposite outer surface 718, as well as at least one lug 70, 71 which protrudes from said outer surface 718. Said lug 70, 71 is intended to prevent the tertiary body from rotating along the horizontal (that is to say, its longitudinal axis) when it is matched with the structure 1 and fixed to an exercise bar.

Advantageously, the hollow tertiary body 69 comprises a shoulder 713 which protrudes from said outer surface 718 and intended to abut against a rim 58 of said hole 10 of an upright of said structure 1. Optionally, each lug 70, 71 is located at a distance from said shoulder 713 to provide an interstitial space 72 between the lug 70, 71 and the shoulder 713.

Advantageously, the cross-section of said tubular side wall 714 is of oval or circular shape. More advantageously, the tertiary body 69 has a cylindrical tube shape of circular or oval cross-section.

Preferably, the tertiary body 69 comprises at least two lugs 70, 71 which protrude from the outer surface 718 and which are not located on the same diameter of said circular or oval cross-section.

Advantageously, the tertiary body 69 comprises a gripping thumbwheel 73, said thumbwheel 73 being preferably formed by teeth 74 located on the circumference of the outer surface 718 of the tertiary body 69.

Preferably, the diameter of said tertiary body 69 is fitted to that of a hole 10 of the sports exercise structure 1.

Advantageously, the assembly device 5 comprises a fixing means for fixedly fastening said tertiary body 69 to the accessory. More advantageously, said accessory is an exercise bar 31, the male connector being then formed by an end portion of said bar 31, and the assembly system comprises a means for permanently fixing the tertiary body 69 to the bar 31 through a fixed joint. More advantageously again, the fixing means comprises a screw 82 intended to secure said tertiary body 69 and said bar 31, the screw crossing said tertiary body 69 and said bar 31 and preferably crossing a lug 70, 71 of said tertiary body 69.

Preferably, said tertiary body 69 is fixed along said exercise bar 31 so that a portion of said bar 31 protrudes on either side from said tertiary body 69, as shown in FIG. 1. in other words, said exercise bar 31 passes right through said tertiary body 69. In other words again, the tertiary body 69 is threaded on the exercise bar 31.

Advantageously, one or more of the hollow main body 51, the secondary body 62 and the tertiary body 69 are made of plastic material, and are preferably made by injection/molding of plastic material. Even more advantageously, the three bodies come from the same mold and thereafter machined.

Advantageously, and as illustrated for example in FIGS. 12 to 17, the structure 1 includes at least one upright which extends longitudinally between a first and a second end, said uptight being a metal profile 800 with a hollow cross-section comprising at least two opposite sides 78, 79, said hole 10 being provided transversely through the entire thickness of said upright so as to cross each of the opposite sides 78, 79, said hole 10 then crossing at least two thicknesses of materials E1, E2 and the hollow cross-section of said profile 800, said hole 10 comprising two substantially circular or oval cavities 80, 81 facing each other relative to the horizontal and each formed in one of said different opposite sides 78, 79, said cavities 80, 81 being each delimited by a rim 58*a*, 58*b* of the material on their respective side 78, 79. Preferably, each cavity 80, 81 is formed by a slot formed through the entire thickness E1, E2 of the concerned wall of said profile 800, as illustrated in FIGS. 12 and 13. In other words, said hole 10 is in this case advantageously composed of two cavities or slots 80, 81 each crossing one of said opposite sides 78, 79, said cavities or slots 80, 81 substantially cutting a disc shape in said concerned side 78, 79 of said profile 800.

Alternatively, and as illustrated for example in FIG. 17, the sports exercise system comprises a first profile 800 and a second profile 801 as described above, said profiles 800, 801 being disposed parallel to and at a distance from one another, the hole 10 of said first profile 800 being aligned with the hole 10 of said second profile 801 relative to the horizontal. Advantageously, the two profiles 800, 801 are substantially identical.

Alternatively, said accessory forms at least in part said male connector. Advantageously, said accessory is an exercise bar 31.

Preferably, for the main 51 and secondary 62 bodies as described above and illustrated in FIGS. 8 and 9, the distance between the shoulder 513, 613 and the lug 56, 57, 64, 65 is greater than the thickness E1, E2 of the rim 58*a*, 58*b* of a side 78, 79 of a profile 800. Advantageously and as illustrated in FIGS. 12, 13 and 17, the profile 800 has at least one notch 76, 77 made in one rim 58*a*, 58*b* of one of said holes 10, said notch 76, 77 being intended to pass a lug 56, 57, 64, 65 of the main 51 and secondary 62 bodies. This configuration, as illustrated in FIGS. 12, 13 and 17, allows passing a portion of one of said bodies 51, 62 into a cavity 80, 81, said portion comprising a lug 56, 57, 64, 65, said lug 56, 57, 64, 65 engaging in the notch 76, 77 of suitable shape, said shoulder 513, 613 abutting then against a rim 58*a*, 58*b*. By rotating said body 51, 62 along its longitudinal axis, it is made secured to the profile 800, the rim 58*a*, 58*b* preventing the lug 56, 57, 64, 65 from bringing said body 51, 62 out of the profile 800.

FIG. 14 illustrates the same assembly device 5 as that of FIG. 10, with, in addition, said profile 800 positioned between said main body 51 and said secondary body 62. Said main 51 and secondary 62 bodies are engaged in a hole 10 of said profile 800, and said bar 31 passes right through the main body 51 longitudinally and almost entirely the profile 800 transversely. Said secondary body 62 prevents the bar 31 from coming out of the hole 10 to completely cross the profile 800.

Advantageously and as illustrated in FIGS. 15 to 17, the tertiary body 69 is fixed to said bar 31 by means of the fixing means described above, preferably a screw 82, and engaged in one of said holes 10 through one of said cavities 80. The tertiary body 69 and the cavity 80 have complementary conformations which have interlocked cooperation when the tertiary body 69 is in the hole 10 so as to prevent any rotation of the tertiary body 69 in the hole 10 along the axis parallel to the horizontal. FIG. 15 illustrates a tertiary body 69 fixed on an exercise bar 31, the exercise bar being engaged in a hole 10 of a profile 801, before engagement of the tertiary body 69 in the hole 10. For example, and as illustrated in FIG. 16, one of said cavities 80 has at least one notch 77 formed in the rim 58*a* of said profile 801, and at least one lug 70 of said tertiary body 69 is intended to engage in said notch 77 to prevent the rotation of the bar 31.

Preferably, and as illustrated in FIG. 17, the mounted sports exercise system comprises two profiles 800, 801 as described above, a main body 51, a first and a second substantially identical secondary body 62, a tertiary body 69 and an exercise bar 31. Advantageously, said respective shoulders 513, 613 of said main body 51 and of said first secondary body 62 abut respectively against opposite first 78 and second 79 sides of said first profile 800, and said respective shoulders 613, 713 of said second secondary body 62 and of said tertiary body 69 abut respectively against opposite first 78 and second 79 sides of said second profile 801. Particularly advantageously, the internal diameters of the secondary 62 and tertiary 69 bodies are substantially identical, and the inner diameter of the main body 51 is substantially greater than said internal diameters of said secondary 62 and tertiary 69 bodies, for example greater than 2 to 5 mm. This particularly advantageous configuration allows having a displacement between the second profile 801 and the bar 31, when the latter is already engaged in a hole 10 of the first profile 800, said hole 10 being provided with a main body 51 engaged inside. Thus, the secondary 62 and tertiary 69 bodies have internal diameters substantially identical to the diameter of a longitudinal cross-section of the bar 31, while the main body 51 has a substantially greater diameter.

Optionally, at least one notch (not shown) is formed in the wall of the profile 800, 801, said notch being distinct from said holes 10, notches 76, 77 and cavities 80, 81 and intended to receive said hook 622. This allows storing the secondary body 62 when the exercise system is dismounted, thus avoiding the misplacement of the secondary body and the waste of time that the destocking of the secondary body represents, the latter being still available hooked to the profile 800, 801.

For example, the mounting of an exercise bar 31, in particular a pull-up bar, on a structure 1 comprising two vertical profiles 800, 801 as described, is carried out according to the steps which, in relation to the embodiment of the FIGS. 8 to 17, will be described below. Before the mounting, such a structure 1 generally includes a multitude of holes 10 in each of the profiles 800, 801. Advantageously, all the holes 10 of the first profile 800 each comprise, on the left side of the profile 800, a secondary body 62 as described above, and on the right side, a main body 51 as described above, each main body 51 being provided with its plug 53 obstructing the orifice in order to prevent any inadvertent penetration of a foreign body in said holes 10. In the same way, the second profile 801, located to the right of the first profile 800, has holes 10 each provided, on the left side of the second profile 800, with a secondary body 62 as described above and, on the right side, with another secondary body 62. When not in use, all the holes of the structure 1 are therefore permanently obstructed using a main 51 or secondary 62 body, preventing the hollow profiles 800, 801 of the structure 1 from accumulating dirt or the user from getting caught in a hole 10. In other words, when not in use, there is no more free hole 10, since they are all obstructed by the plug 53 of a main body 51 or the bottom 84 of a secondary body 62. In order to mount the bar 31, it is therefore necessary to remove at least one secondary body 62 from the left of the profile 801 and remove the plug 53 from the main body of the profile 800 facing said secondary body 62 of said profile 801. Advantageously, the secondary body 62 may be hooked to said hook 622 for storage for the duration of the exercise (in the case where the mounting of the bar is made only for the duration of an exercise). The mounting of a bar 31 can then begin according to the following steps:

- Optionally, if it is not already done, a tertiary body 69 is fixed to a bar 31 by means of a screw 82, in a predetermined position of the bar 31;
- Said main body 51 is engaged in a first cavity 81 of a hole 10 of said first profile 800, said first cavity 81 being opposite a cavity 80 of a hole 10 of said second profile 801. The lug 56 of said body main 51 crosses the notch 76, then the shoulder 513 abuts against the rim of the cavity 81 of said first profile 800. Then the main body 51 is rotated along its longitudinal axis to make it secured to said side 78 of said first profile 800, by capturing the rim of the first cavity 81 between the lug 56 and the shoulder 513.
- A first end 31*a* of the bar 31 is engaged in the empty volume of the main body 51, preferably by keeping the second end 31*b* of the bar close to the second profile 801. This is possible thanks to the displacement or clearance allowed between said second end 31*b* of the bar 31 and the profile 801. This displacement exists thanks to the matching of a main body 51 whose inner diameter is larger than that of the bar 31
- The bar 31 is further pushed into said hole 10 so that it passes right through said first profile 800, then it crosses a first cavity 81 of said hole 10 of said second profile 801.
- The bar 31 is pressed into said hole 10 of the second profile 801 until the lug 70 is engaged in a notch 77 of said first cavity 81 of said second profile 801.
- Said first secondary body 62 is engaged in a second cavity 80 of said hole 10 of said first profile 800, said second cavity 80 of said first profile 800 being opposite said second cavity 81 of said first profile 800. Said lug 64 of said secondary body 62 crosses said notch 77, then said shoulder 613 abuts against the rim of said second cavity 81. The secondary body 62 is then rotated along its longitudinal axis so as to make it secured to said side 77 of said first profile 800. The first secondary body 62 caps then said first end 31*a* of said bar 31 and prevents it from moving along its axial direction.
- The same is done with the second secondary body 62, engaged in a second cavity 80 of said hole 10 of said second profile 801. The first secondary body 62 then caps said first end 31*a* of said bar 31 and prevents it from moving along its other axial direction. Obviously, it is possible to interchange the last and the penultimate step.

The bar is thus blocked in rotation by said tertiary body 69 and in axial displacement by said two secondary bodies 62, said secondary 62 and tertiary 69 bodies supporting the load of the bar 31 in use. Said main body 51, of internal diameter greater than the secondary 62 and tertiary 69 bodies, has the main function of protecting said structure 1 when the bar 31 is used, that is to say avoiding degradation of the rim of said first cavity 81 of said first profile 800. Optionally, the main body 51 can also support the load of the bar 31, for example if it tends to bend under the weight of a user. This gives the exercise system according to the invention a significant security and ease of use since the bar 31 does not rotate, while keeping a system dismountable easily and without tools.

Alternatively, and as illustrated in FIG. 18, the exercise structure 1 comprises two posts or two profiles 800, 801 as previously described, disposed vertically, and two metal parts 85, 86, generally in the shape of an obtuse angle, each part 85, 86 being intended, on the one hand, to partially surround a longitudinal portion of one of said posts or profiles 800, 801 and, on the other hand, to receive an exercise bar 31 with the main 51, secondary 62 and tertiary 69 bodies as described previously. Preferably, the two parts 85, 86 are identical and each part 85, 86, includes a first end 87, 88 extending longitudinally and of generally U-shaped cross-section, said first end 87, 88 being intended to come alongside a profile 800, 801, and a second end 89, 90 composed of a profile portion as described above, said second end 89, 90 being intended to receive the exercise bar 31. The first end 87, 88 is joined with an end portion of the second end 89, 90, said first 87, 88 and second 89, 90 ends forming an obtuse angle therebetween. In other words, FIG. 18 illustrates an upright composed of a profile 800, 801 and of a metal part 85, 86, said metal part allowing to install the exercise bar 31 even higher than the profile 800, 801. Very preferably, the second end 89, 90 and the profile 800, 801 each extend in a longitudinal direction, and their longitudinal directions form together an angle comprised between 40° and 50°, advantageously about 45°.

Preferably, said metal part 85, 86 mates with said profile by means of an assembly device (not shown here) according to the invention via through holes 10 made in said second ends 87, 88, said holes 10 of said second ends 87, 88 being identical in size to the holes 10 of said profiles 800, 801. This gives a great modularity to the physical exercise structure according to the invention, while benefiting from a reduced bulk and an easy assembly.

In addition, the assembly device 5 has a remarkable safety feature for the users insofar as it allows avoiding the presence of cutting edges, which would be formed by the holes 10 made inside the structure elements of said sports exercise structure 1. Indeed, these holes 10 being equipped with said assembly device, and in particular with the hollow main body 51, the sharp metal edges of the holes 10 are advantageously replaced by a tube preferably made of plastic material, eliminating then the risks of cuts if a user introduces (voluntarily or involuntarily) his finger inside.

The invention also concerns as such an assembly system comprising an assembly device 5 as defined above as well as the male connector defined above.

The invention also concerns as such a sports exercise system comprising at least:

- a sports exercise structure 1 including at least one hole 10, preferably as described above,
- an accessory, advantageously similar to the one described previously,
- a male connector, advantageously similar to the one described previously,
- and a device 5 for assembling said accessory to said structure 1 according to one of the embodiments described above, said male connector being intended to be inserted into said hollow main body 51 by the first opening 511 in order to connect said accessory and assembly device.

The invention also concerns as such a method for constructing a sports exercise system comprising a sports exercise structure 1 including at least one hole 10, said method comprising a step of inserting into said hole 10 a hollow main body 51 which is provided with at least a first opening 511 and further comprising either of the following alternative steps:

- a step of sealing said first opening 511 by means of a first removable plug 53, or a step of assembling an accessory to said structure 1, during which a male connector is removably received within said hollow main body 51 by insertion of said male connector within the main body 51 by said first opening 511, in order to connect said accessory to the hollow main body 51, so as to leave no holes 10 or apparent openings 511 within said structure 1.

POSSIBILITY OF INDUSTRIAL APPLICATION

The invention finds its industrial application in the design, manufacture and use of an assembly device for assembling an accessory to a sports exercise structure.

The invention claimed is:

1. A sport exercise system comprising:

a sports exercise structure (1) including at least one hole (10);

an accessory;

a male connector; and an assembly device (5) of said accessory to said structure (1), said device (5) including:

at least one hollow main body (51) which extends longitudinally between two ends, which is provided with at least a first opening (511) and which is configured to be inserted into said hole (10) and to removably receive said male connector, said male connector configured to be inserted into said hollow main body (51) through the first opening (511) in order to connect said accessory and assembly device, said main body (51) delimiting a continuous empty inner volume opening at each end to form respectively said first opening (511) and a second opening (516); and a first removable plug (53) configured to seal said first opening (511) when the male connector is not inserted into said hollow main body (51), the main body (51) comprising a tubular side wall (514) having an inner surface (517) configured to face the male connector and an opposite outer surface (518), and at least one lug (56, 57) which protrudes from said outer surface (518).

2. The sport exercise system according to claim 1, further comprising a substantially flexible link (55) connecting said first removable plug (53) to said main body (51).

3. The sport exercise system according to claim 2, wherein the main body (51) is integral with the first plug (53) and the link (55).

4. The sport exercise system according to claim 3, wherein the cross-section of said tubular side wall (514) is of circular or oval shape.

5. The sport exercise system according claim 1, wherein the hollow main body (51) comprises a shoulder (513) which protrudes from said outer surface (518) and which is disposed to abut against a rim (58) of said hole (10) of said structure (1).

6. The sport exercise system according to claim 1, wherein each lug (56, 57) is located at a distance from said shoulder (513) to provide an interstitial space (59) between the lug (56, 57) and the shoulder (513).

7. The sport exercise system according to claim 1, wherein the hollow main body (51) is made of plastic material, and is made by injection/molding of plastic material.

8. The sport exercise system according to claim 1, further comprising at least one hollow secondary body (62) which extends longitudinally between two ends, which is distinct from and independent of the hollow main body (51) and provided with a blind orifice (63), and which is configured to be inserted into said hole (10) and to removably receive within the blind orifice (63) a free end of said male connector in order to connect said accessory and hollow secondary body (62).

9. The sport exercise system according to claim 8, wherein said secondary body (62) comprises a tubular side wall (614) having an inner surface (617) disposed to face the male connector and an opposite outer surface (618) and at least one lug (64, 65) which protrudes from said outer surface (618).

10. The sport exercise system according to claim 9, wherein the cross-section of said tubular side wall (614) is of circular or oval shape.

11. The sport exercise system according to claim 8, wherein the hollow secondary body (62) further comprises a shoulder (613) which protrudes from said outer surface (618) and which is disposed to abut against a rim (58) of said hole (10) of an upright of said structure (1).

12. The sport exercise system according to claim 9, wherein each lug (64, 65) is located at a distance from said shoulder (613) to provide an interstitial space (66).

13. The sport exercise system according to claim 8, further comprising a hollow tertiary body (69) which (i) extends longitudinally between two ends, (ii) is distinct from and independent of the main (51) and secondary (62) bodies, (iii) delimits a continuous empty inner volume opening at one end and (iv) is configured to be inserted into one of said holes (10) and to receive an exercise bar (31), which when inserted into said hollow tertiary body (69) in said continuous inner volume, connects said bar (31) and hollow tertiary body (69).

14. The sport exercise system according claim 13, wherein the tertiary body (69) comprises a tubular side wall (714) having an inner surface (717) disposed to face the exercise bar (31) and an opposite outer surface (718), as well as at least one lug (70, 71) which protrudes from said outer surface (718).

15. The sport exercise system according claim 13, wherein said hollow tertiary body (69) comprises a shoulder (713) which protrudes from said outer surface (718) and which is disposed to abut against a rim (58) of said hole (10) of an upright of said structure (1).

16. The sport exercise system according to claim 13, further comprising a fixing means for fixedly fastening said tertiary body (69) to the accessory.

17. The sport exercise system according to claim 1, wherein said male connector is secured to said accessory, and is integral with said accessory.

18. The sport exercise system according claim 13, wherein said accessory is an exercise bar (31), the male connector being formed by an end portion of said bar (31) and comprising a means for permanently fixing the tertiary body (69) to the bar (31) through a fixed joint.

19. The sport exercise system according to claim 13, wherein the tertiary body (69) is fixed along the exercise bar (31) so that a portion of said bar (31) protrudes on either side from on both sides of the tertiary body (69).

* * * * *